United States Patent [19]

Bryant, Jr.

[11] 4,117,661

[45] Oct. 3, 1978

[54] PRECISION AUTOMATIC LOCAL TIME DECODING APPARATUS

[76] Inventor: Ellis H. Bryant, Jr., 4881 Powers Ferry Rd., NW., Atlanta, Ga. 30327

[21] Appl. No.: 750,431

[22] Filed: Dec. 14, 1976

Related U.S. Application Data

[63] Continuation of Ser. No. 557,402, Mar. 10, 1975, abandoned, which is a continuation of Ser. No. 406,982, Oct. 16, 1973, abandoned.

[51] Int. Cl.[2] ..... G04C 13/02

[52] U.S. Cl. ..... 58/24 R; 325/58; 343/225; 340/147 SY; 179/6 TA

[58] Field of Search ..... 58/23 R, 24 R–26 R; 179/6 TA, 100.1 C; 325/58, 66, 67; 340/170 ST; 343/225–228

[56] References Cited

U.S. PATENT DOCUMENTS

| | | | |
|---|---|---|---|
| 3,646,444 | 2/1972 | Bitzer | 325/58 |
| 3,648,173 | 3/1972 | Elliot | 325/58 |
| 3,751,900 | 8/1973 | Phillips et al. | 58/24 R |
| 3,798,650 | 3/1974 | McComas et al. | 343/225 |
| 3,902,161 | 8/1975 | Kiowski et al. | 340/147 SY |
| 4,014,166 | 3/1977 | Cateora et al. | 343/225 X |

*Primary Examiner*—Robert K. Schaefer
*Assistant Examiner*—Vit W. Miska
*Attorney, Agent, or Firm*—Watson, Cole, Grindle & Watson

[57] ABSTRACT

The time detecting apparatus receives repetitive binary coded sets of data including time data in a predetermined format. The components of a single set of the received data representative of time are detected and stored. After a preselected time interval the detecting means are again actuated to determine the time components from a successive binary coded set of the received data and the previously stored time components are updated by the preselected time interval. The updated stored time components are then compared with the time components of the latter detected successive set of data to generate signals indicating whether or not the respective sets of time components are identical to determine that the detected time components are accurate. If the compared sets of data are identical then the updated data is read out from the storage means to provide accurate time signals for timing and setting local clocks and other control functions.

24 Claims, 16 Drawing Figures

SHIFT REG. RESET
230
SHIFT REG. CLOCK
152
55 SEC. INPUT
FROM TERMINAL 170 FIG 2B
206
53 SEC. OUTPUT
TO FIG. 2E
288
LATCH INPUT
FROM FIG. 2A
172
FROM FIG. 2B
132
1ST REP.
TO FIG. 2E
252
299
FROM FIG. 2E
TO FIG. 2A
303
TO FIG. 2D
218
207
208 SR
210 SR
212 SR
214 SR
216 SR
CLK
+5V
Vcc
280 DAY LATCH
282 DAY LATCH
284 DAY LATCH
298 DAY COMP.
300 DAY COMP.
302 DAY COMP.
240
242
244
246
248
250
286

PRECISION AUTOMATIC LOCAL TIME DECODING APPARATUS

This is a continuation, of application Ser. No. 557,402 filed Mar. 10, 1975, now abandoned, which is a continuation of Ser. No. 406,982, filed Oct. 16, 1973, now abandoned.

This invention relates to time code decoding apparatus and more particularly to apparatus for setting automatically time of day voice announcement machines and local clocks from the National Bureau of Standards (NBS) modified IRIG-H digital time code transmitted by radio stations, WWV, WWVH and over the telephone lines from Ft. Collins, Colo.

This system overcomes the primary factors responsible for the fact that no completely automatic and precision service existed in the past that made use of the NBS digital time code for the setting of local clocks. The Daylight time and Standard time changes are irregular relative to the numerical day of the year, as defined by the Standard Time Act (1966) Title 15 Section 260. The changes occur at 2:00 A.M. local time on the last Sundary morning in April and at 2:00 A.M. local time on the last Sunday morning in October. No practical way had been devised to accomplish this function automatically.

GMT time and the numerical day of the year were the only time information transmitted by NBS in their digital IRIG-H modified time code prior to this invention. There was no economically practical way for equipment to be programmed to automatically correct NBS transmissions to provide local time to the public in any given time zone. This was due to the fact that the local time changes from Standard to Daylight and vice-versa are irregular and it would be necessary to know the calendar year to provide such a program. The possibility of several years storage of the equipment without power makes this practically jnfeasible. This invention overcomes this problem and as a result of the design and construction of the apparatus described herein, the NBS further modified the IRIG-H time code that it transmits to provide an identifier pulse so that the equipment receives "Daylight" information for six months each year. The system now can start up exactly on the correct local time automatically after receiving a correct GMT time code from the NBS when the power is applied.

The NBS first provided trail broadcasts of the daylight correction factor during the summer of 1972 to test this invention. The "Daylight" information was incorporated permanently in its IRIG-H modified code to provide this service to the public on Oct. 1, 1972. The change was first announced in NBS bulletin #104 dated Sept. 16, 1972.

After the initial radio update on start-up, any changes in the received daylight code that is accepted to update the master clock are delayed until 2:00 A.M. local time. This provides an advance of one hour of local time when changing to daylight time. The daylight signal begins at 00:00:00 hours GMT on the last Sunday in April providing several hours for a correct update prior to the time it is first needed in the USA at 2:00 A.M. local EST. The NBS personnel operate a switch manually at the transmitter locations of WWV and WWVH at 00:00:00 hours GMT on the last Sunday of April. These switches cause the WWV time code generators to provide the daylight pulse each minute until 00:00:00 GMT on the last Sunday of October 6 months later they are cut off manually reversing the process. At 2:00 A.M. local time the announcement machines and clocks are returned to standard time. There are manual controls for locking out the automatic daylight feature at the machine in the event the system is located in a community where the local time does not change.

Another important feature of the invention is the improved time code detection making an automatic local system practical. The nature of the IRIG-H time code transmitted over the services of WWV, WWVH and the telephone lines is a one frame per minute 60 bit 100 Hz code. Static fading, ionosphere disturbances and other radio interference normally encountered in the long distance reception of these high frequency transmissions that will cause errors in the detection of the time code are usually determined by matching and comparing the time code format with the actual received code. Any differences will reject the particular time frame. This works very well most of the time, but occasionally a burst of static will occur during the sampling period of the actual BCD time information causing a "zero" to change to a "one", thereby detecting an incorrect time code that continues to have a correct format. A wrong set of the local clock will result in this type of system. This invention eliminates this type of error by detecting the time code and adding a fixed time to it, for example one minute, and storing the result in the system's memory. With the next minute of code detected as correct, the stored code is compared one minute later with the new code from the just detected code. When the stored code and the new correct time code are exactly the same, the new code is entered into the master clock to update it within a few milliseconds of the actual time. This occurs at the beginning of the 56th second, each minute when the received detected codes are perfect. In the event of a faulty time code, or the failure to detect any one minute time frame, the stored code is canceled, and the cycle is started over. This provides the opportunity for many additional updates daily. In Atlanta, Georgia, using the 15 MHz band about 1500 updates occur each day. No incorrect time code has ever been entered into the master quartz clock using this invention.

The time information in the master clock that was automatically updated by the NBS is in GMT. A five level binary switch is adjusted initially on installation to provide for the local time zone offset. This is used to program the local time logic circuit adders that provide the twenty four hour local time. The output of the "Daylight" identifier also adds 1 hour to the local time during the "Daylight" 6 months. Additional logic is provided to accommodate the start up, 2:00 A.M. transfer, and defective code cycle reset functions. The twenty four hour local time is converted into twelve hour local time, providing a parallel binary output of hours, minutes, and seconds that is exactly on time all of the time.

The apparatus of this invention is used for detecting the digital time code transmitted by the NBS. This updates the local GMT master clock. The detection of the number "six" control function transmitted by NBS during the fifty-fifth second of each time frame for six months of each year is used for a "Daylight" identifier. The binary code conversions then provide local precision time. This output is used to control the Electromechanical Telephone Announcement System described in U.S. Pat. application Ser. No. 364,529 now U.S. Pat. No. 3,876,840, issued Apr. 8, 1975. This same system may be used to control and provide precision time voice announcements over the telephone from the new non-mechanical read only memory devices that are capable of storing segments of a prerecorded human voice in digital form.

It is a primary object of this invention to provide improved apparatus for decoding tine codes.

It is another object of this invention to provide apparatus for the automatic or manual insertion of time changes from daylight to standard time and vice-versa.

It is a further object of this invention to provide improved time code decoding apparatus for operation and association with the updating of a master time clock for the conversion of GMT to local hour time.

It is yet another object of this invention to provide improved fully automatic precision time decoding and apparatus for updating master time clocks.

BRIEF DESCRIPTION OF THE FIGURES

FIGS. 3A to 3C respectively represent a P pulse, a binary "1" and a binary "0" of the time code illustrated in FIG. 1;

FIG. 3D illustrates the data sampling pulses of the decoder apparatus;

FIGS. 3E to 3G respectively represent the detection of a "P" pulse, a binary "1" and a binary "0";

DETAILED DESCRIPTION

WWV TIME CODE

Since July 1, 1971 The National Bureau of Standards (NBS) commenced broadcasting time code which is continuously transmitted by both radio stations WWV and WWVH on a 100 Hz sub-carrier. The NBS time code is used as a standardized timing base for scientific observations which are simultaneously made at widely separated locations. Satellite telemetry is one example of the use of the time code wherein the telemetry signals are recorded along with the time code thereby aiding subsequent analysis of the data using the unambiguous time markers which are accurate to about 10 milliseconds.

Figure 1:
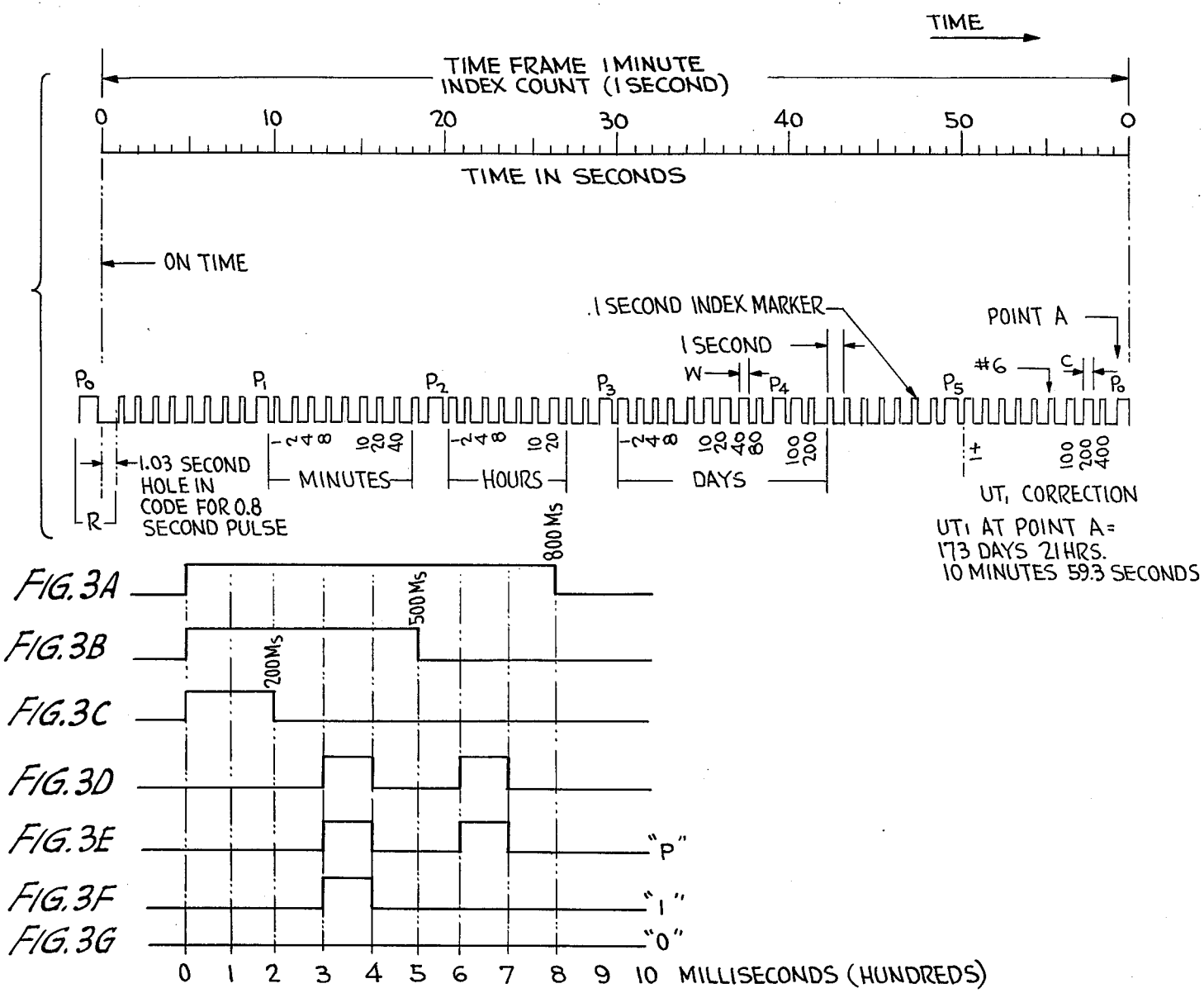
FIG. 1 is a chart of the time code transmissions from the NBS radio stations WWV and WWVH.

The code format is illustrated in FIG. 1 and is a modified IRIG-H time code. The code is produced at a 1 pps rate and is carried on the 100 Hz modulated sub-carrier which is synchronous with the code pulses so that 10 millisecond resolution is readily obtainable. The code contains coordinated universal time (UTC) information in minutes, hours, and day of the year. Seconds information may be obtained by counting pulses.

As illustrated in FIG. 1, the code comprises a binary coded decimal (BCD) system wherein each minute contains seven BCD groups in the following order: two groups for minutes, two groups for hours, and three groups for day of the year. The code digit weighting is 1-2-4-8 for each BCD group multiplied by 1, 10 or 100 as the case may be. A complete time frame is 1 minute, and the binary groups follow the 1 minute reference markers, $P_o$ plus the 1.03 second hole.

In the standard IRIG-H format, "ON-time" occurs at the leading edge of all pulses. A binary 0 pulse comprises 20 cycles of one hundred Hz amplitude modulation; a binary 1 pulse comprises 50 cycles of 100 Hz amplitude modulation. Because of the 40 millisecond hole that accompanies each seconds marker in the WWV/WWVH format, however, the leading 30 millisecond portion in the time code is deleted. The leading edge of each pulse coincides with a positive going zero axis crossing of the 100 Hz modulating frequency.

The code contains six position identification markers per minute and a minute reference marker which is based upon a clocking rate of 60 pulses per minute. Each position identification marker consists of a 0.8 second pulse preceding a code group. The one minute reference marker consists of a 0.8 second pulse followed by a 1.03 second hole in the code and followed by 8 successive binary zero pulses. The minute begins with the 1.03 second hole preceding the first binary 0.

UT1 corrections to the nearest 0.1 second are encoded via control function pulses during the final 10 seconds of the frame. UT1 is defined from the earth's rotation rate and the new UTC rate (effective Jan. 1, 1972) is no longer periodically adjusted to agree with the earth's rotation rate and UTC departs more rapidly than before from earth's rotation time. Control function No. 1 which occurs as the fiftieth second pulse, discloses the sense of the correction. Control function No. 1 is a binary 0 when the UT1 correction is negative and a binary 1 when the correction is positive. Control functions Nos. 7, 8 and 9, which occur respectively as the fifty-sixth, fifty-seventh, and fifty-eighth second pulses, identify the magnitude of the UT1 correction.

Control function No. 6, which occurs as the fifty-fifth second pulse, is programmed as a binary 1 during those weeks when daylight saving time is in effect and is a binary zero when standard time is effective. The setting of control function No. 6 is changed at 00:00GMT on the last Sunday of April and October, respectively. Such a schedule throughout the United States enables several hours for the daylight saving time function to be received before the change actually is to become effective locally, i.e. at 2:00 A.M. Thus, control function No. 6 provides a feature whereby clocks or digital recorders operating on local time can be programmed thereby enabling an automatic 1-hour adjustment in changing from daylight saving time to standard time and vice versa.

The decoding apparatus of this invention is designed to automatically decode the aforementioned WWV/WWVH time code. The decoded information can then be used for a number of applications such as the automatic setting of time announcing stations, such as is described in the aforementioned United States patent and entitled "Automatic Time-Temperature-Message Announcing System."

WWV TIME CODE DECODING APPARATUS

The WWV 100 Hz audio input (1 volt RMS) is input at terminal 20 to low pass filter 22 and the output of the low pass filter is amplified by amplifier 24 which is adjusted for a 100 Hz cut-off. That is, all frequencies above 100 Hz are cut-off and the output of amplifier 24 is filtered by active bandpass filter 26 which includes amplifier 28. Bandpass filter 26 is adjusted to a 100 Hz bandpass frequency by resistor 30. Low pass filter 22 and bandpass filter 26 separate the 100 Hz time code that is generated in the WWV signal so that the information data in the WWV transmission can be decoded. Thus, the previously described filters have separated the 100 Hz audio signal from the other signals in the WWV transmission, which other signals are not necessary for the purposes of the present invention.

The filtered 100 Hz output 32 from bandpass filter 26 is fed to terminal 34 where that signal may be used, for example, for automatic volume control in equipment which operates in association with the decoding apparatus described in this invention, which apparatus is fully described in the aforementioned U.S. patent Ser. No. 364,529, filed May, 25, 1973 and entitled "Automatic Time-Temperature-Message Announcing Systems." Terminal 34 is jumpered to terminal 36 to input the 100 Hz signal to amplifier 38 which comprises two amplifier stages 40, 42, each in turn including amplifiers 44, 46. The terminal 36 provides an alternate means for inputting the 100 Hz time code information into the time decoder described in FIG. 1. The amplitude of the time code signal 32 is adjusted by potentiometer 48 and after amplification by amplifier network 38, the amplified time code signals 50, 52, representing the respective outputs of amplifiers 46, 44, are rectified by FET transistors 54, 56. The rectified signal 58, which is now a 200 Hz signal, is input to a detector network to be described below by means of impedance matching transistor 60. Transistor 60 also provides a gating function so that the signals below a threshold level determined by voltage divider 62 are not fed to the decoding circuitry.

The detected and rectified WWV time code data 63 from the collector of transistor 60 is input to re-triggerable dual one-shot multivibrator 64 which operates as follows. One-half of dual one-shot multivibrator 64 performs the function of sampling the 1.03 second hole in the WWV time code as illustrated in FIG. 1. The other half of dual one-shot multivibrator 64 samples the data pulses of the WWV time code. The hole sampling structure is a one-shot multivibrator having terminals 64-5 to 7 and 64-9, 10 and 12. Terminal 64-7 is connected through resistor 66 to the 5 volt VCC supply. Terminal 64-6 is connected to resistor 66 via capacitor 68; a hole sampling gate input (the generation of which will be described hereinafter) is input to terminal 64-9; the time code signal 63 is input to terminal 64-10; the Q output, which comprises a hole detector output signal is obtained at terminal 64-5; and the $\overline{Q}$ output represents a counter reset pulse which is obtained at terminal 64-12.

The other half of dual one-shot multivibrator 64 samples the data and comprises a re-triggerable one-shot multivibrator having terminals 64-1 to 4, and terminals 64-13 to 16. A data sampling gate input (the generation of which will be described hereinafter) is input to terminal 64-1. The time code signal 63 is input to terminal 64-3; terminal 64-16 is connected to the plus 5 volt VCC power source; a reset terminal 64-15 is connected through resistor 70 to the plus 5 volt VCC source; terminal 64-14, which provides a clear function, is connected through capacitor 72 to resistor 70; the Q data output is obtained from terminal 64-13; and the $\overline{Q}$ data output is obtained from terminal 64-4.

The 1.03 second hole detection provides an index for the WWV time code illustrated in FIG. 1. As is evident from that Figure, the 1.03 second hole along with the signal $P_O$ comprises a frame reference marker which appears immediately after the 59th second pulse in the WWV time code. The time constant of resistor 66 and capacitor 68 is set for something greater than one second, for example 1.2 seconds, so that the hole detector half of dual one-shot multivibrator 64 will reset if a signal is not received within that time constant span. The Q and $\overline{Q}$ outputs from terminals 64-13 and 64-4 of one-shot multivibrator 64 represent the time code information in the WWV audio input at terminal 20. The rundown period, that is the time constant of resistor 70 and capacitor 72, is selected to be greater than 50 milliseconds and in the embodiment described herein, is set for approximately 110 milliseconds. Therefore, if a data input is not detected by the data half of one-shot multivibrator 64 within the 110 millisecond rundown period, the multivibrator will be reset. The $\overline{Q}$ data output from terminal 64-4 is input to dual flip-flop 74 and the time code data on the Q output at terminal 64-13 is provided to the J input of dual flip-flop 74 as well as to time decoding circuitry to be described more fully hereinafter for the purpose of providing a control function for the decoding circuitry. The hole detector output at terminal 64-5 operates light emitting diodes to provide an indication of the resetting of the hole sampling circuit of multivibrator 64. The $\overline{Q}$ output from hole sampling terminal 64-12 provides an input signal for generating control function signals which will be more fully described hereinafter.

Figure 2A:
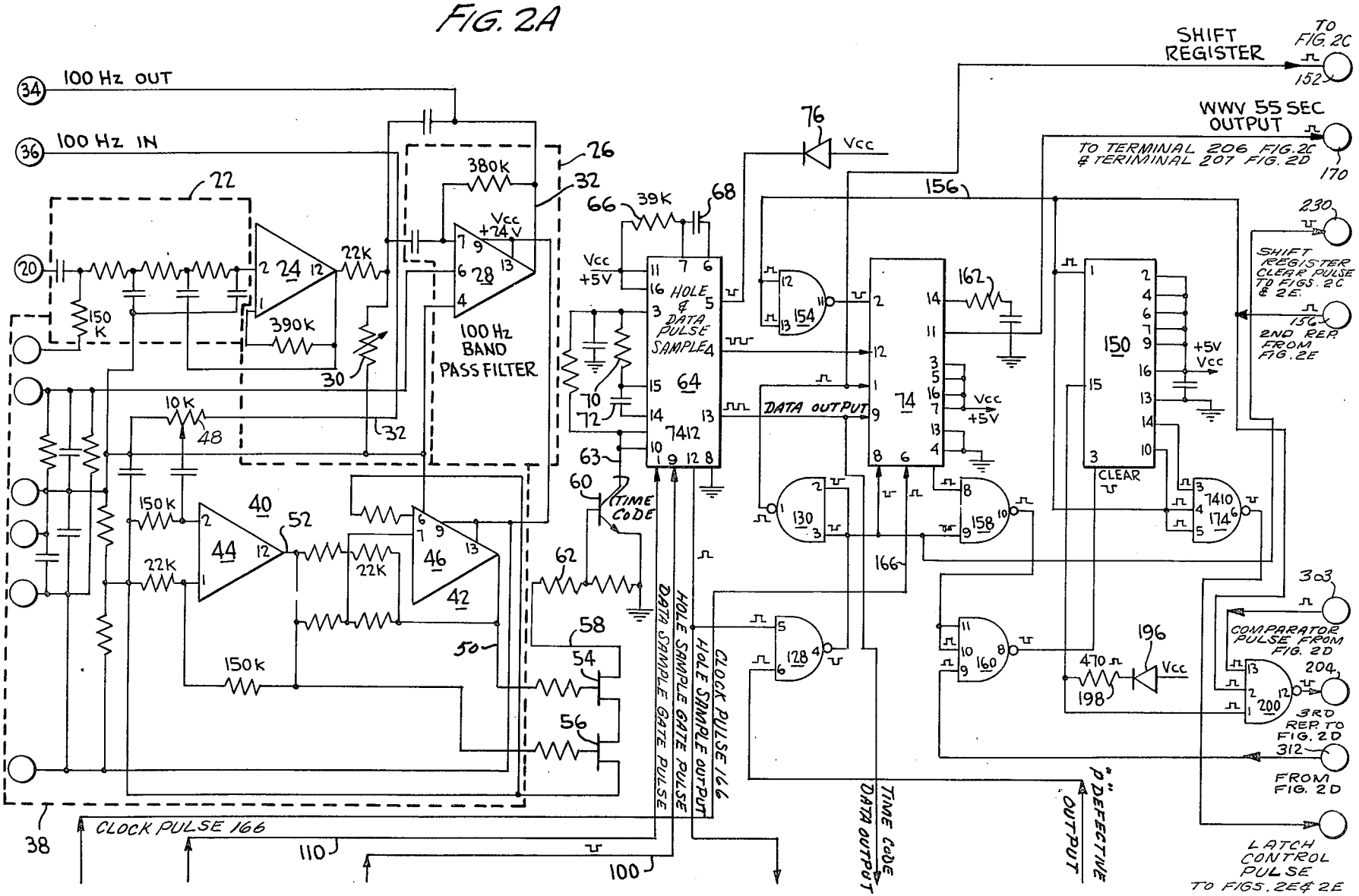
FIGS. 2A to E are schematic diagrams of an exemplary embodiment of time decoding apparatus in accordance with the present invention.
Figure 4:
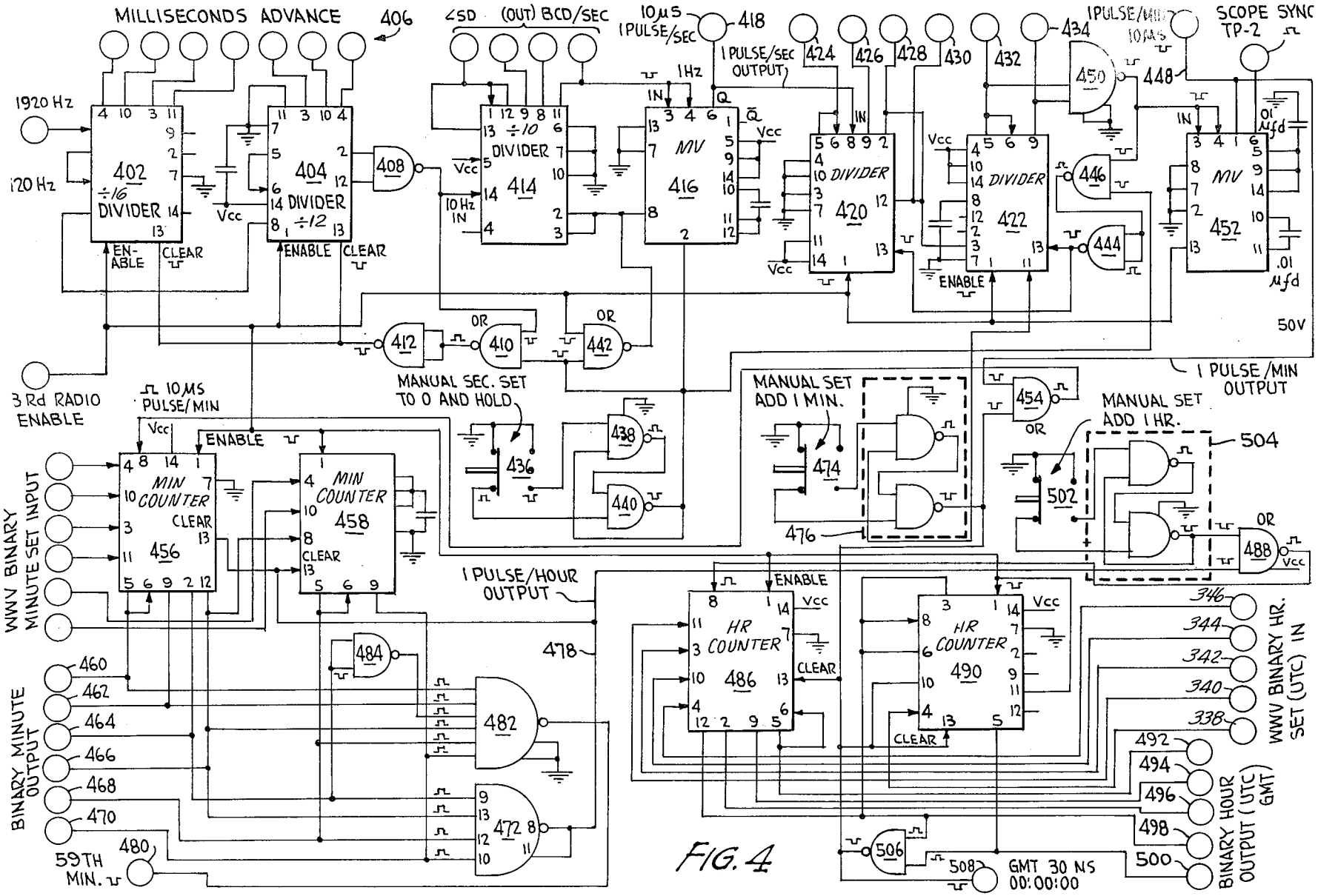
FIG. 4 is a schematic diagram of an illustrative embodiment of the main UTC presettable clock of the present invention.

The necessary control signals for operating the detecting apparatus are described with respect to FIG. 2A wherein the 1920 Hz signal from the 1920 Hz divider circuit 196, FIG. 4 of the aforementioned U.S. Pat., appears at terminal 80 and is input to a divide-by-ten divider 82 to provide a 120 Hz output at terminal 84. Terminal 84 is connected directly to terminal 86 to provide a 120 Hz input to divide-by-twelve divider 88, the output 90 of which is input respectively to divide-by-ten divider 92 and divide-by-ten divider 94; NAND gates, 98 and 101. The reason for the use of terminals 84 and 86 is to enable an independent 120 Hz input to be provided to divide-by-twelve divider 88. Dividers 82, 88 are binary dividers, whereas dividers 92, 94 and 96 are binary coded decimal (BCD) dividers each having respective outputs at terminals 92A - D, 94A - D, and 96A- D.

The outputs A, B, C and D from dividers 92, 94, 96 are weighted as indicated in Table I.

TABLE I

| Output | A | B | C | D |
|---|---|---|---|---|
| Binary Weight | 1 | 2 | 4 | 8 |

Hole sampling gate pulse 100 is generated by appropriate number decoding logic circuitry using the outputs of dividers 82, 88, 92, 94, 96 in the following manner. The A and D outputs from divider 92 are input to NOR gate 102; the B and C outputs of divider 92 are input to NOR gate 104 and the outputs of NOR gates 102, 104 are in turn input to NAND gate 106, which in effect detects the zero time and generates the hole sampling gate pulse 100, which as previously described is input to terminal 64-9 of the hole detector of one-shot multivibrator 64. The purpose of hole sampling gate 100 is to provide a "window" in which the 1.03 hole in the WWV time code is detected, thereby eliminating false detection resulting from noise.

The detection principle utilized in the present invention is explained with reference to FIGS. 3A to 3G. FIG. 3A illustrates a P pulse, which from FIG. 1 is indicated to be 800 milliseconds in width. Similarly, FIGS. 3B and 3C respectively represent a binary "1" and a binary "0" which respectively have pulse widths of 500 and 200 milliseconds. The data sampling is obtained by generating two 100 millisecond spaced windows during the intervals of which the data sampling multivibrator section of multivibrator 64 is actuated. FIG. 3D illustrates the data sampling pulses which are generated between the 300 to 400 and the 600 to 700 milliseconds periods of each second of the time code. FIGS. 3E, 3F and 3G respectively indicate the detection of a P pulse, a binary "1", and a binary "0" in the time code illustrated in FIG. 1.

Figure 2B:
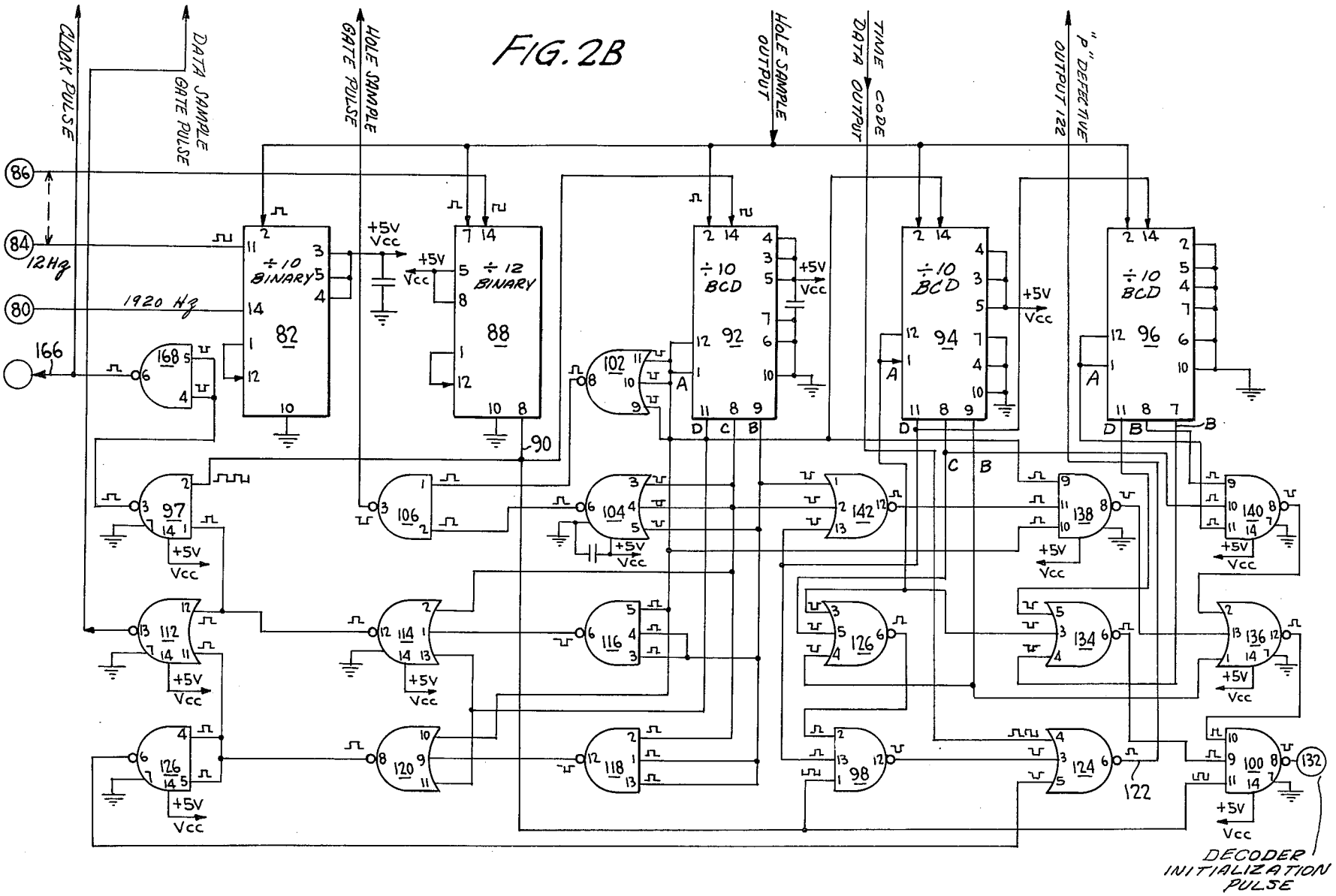

The data sampling gate pulses 110 (illustrated in FIG. 3D) are generated by number decoding circuitry in the following manner with respect to the circuitry illustrated in FIG. 2B. The window between the 300 and 400 millisecond interval of each second is generated by $\overline{\text{NOR}}$ gate (inverter OR gate) 112 which receives the output from NOR gate 114 for detecting the binary number three in the following manner. NAND gate 116 receives the A and B outputs of divider 92 and its output is fed as one input to NOR gate 114. The other inputs to NOR gate 114 are the C and D outputs of divider 92.

The sampling gate pulse within the 600 to 700 millisecond intervals of each second (FIG. 3D) is generated by $\overline{\text{NOR}}$ gate (Inverter OR gate) 112 in the following manner. NAND gate 118 receives the B and C ouputs of divider 92 and the output thereof is fed as one input to NOR gate 120. The other two inputs to NOR gate 120 are the A and D outputs of divider 92. The output of NOR gate 120 thus represents a pulse occurring between the 600 and 700 millisecond interval of each second of the time code. The output of NOR gate 120 is provided as an input to $\overline{\text{NOR}}$ gate 112 (which functions as an OR gate) to generate the data sampling gate pulse 110 which is input to the data sampling section of multivibrator 64. The data sampling section of multivibrator 64 is thus turned ON only during the presence of data sampling gate pulses 110. In this manner the data sampling section of multivibrator 64 will detect a P pulse by the presence of two output pulses appearing during the same interval as the data sampling gate pulse 110 (as illustrated in FIG. 3E). In a similar manner the presence of a binary "1" and a binary "0" in the time code are respectively indicated by the signals represented by FIGS. 3F and 3G.

The $\overline{Q}$ output from the hole sampling section of multivibrator 64 clears counters 82, 88, 92, 94, 96 so that the aforementioned operation for generating hole sampling gate pulse 100 and data sampling gate pulses 110 will be repeated for each one second interval during which the 1.03 second hole in the time code illustrated in FIG. 1 is detected.

The decoder circuitry described herein has the capability of detecting the aforementioned binary "zero" or binary "1" which is inserted in the fifty-sixth second interval of the time code illustrated in FIG. 1. In order to detect the daylight indicator, it is necessary to generate a decoder initiation pulse to initialize the decoder circuitry prior to the fifty-sixth second of the time code. The remainder of the decoding circuitry illustrated in FIG. 2B provides the aforementioned decoder initialization pulse as well as a control pulse which indicates when any one or more of the $P_1$ to $P_5$ pulses have not been detected in the time code. The P-defective control pulse is generated by NOR gate 124 in the following manner. The Q output from terminal 64-13 of multivibrator 64 is provided as one input to NOR gate 124 (FIG. 2B). The output of NAND gate 98, along with the inverted output of inverter 126, which inverts the output of NOR gate 120, comprise the other two inputs to NOR gate 124. Thus, NOR gate 124 will provide a P-defective pulse output 122 when any one of the $P_1$ to $P_5$ pulses have not been detected by the data sampling section of multivibrator 64. The output of NAND gate 98 is generated from a 10Hz output 90 from divider 88, the D output of divider 94, and the output of $\overline{\text{NOR}}$ gate 126. NOR gate 126 has three inputs, namely, the A, B and C outputs of divider 94.

With respect to FIG. 2A control pulse 122 is provided as one input, along with $\overline{Q}$ the hole sample output of terminal 64-12 of multivibrator 64 to $\overline{\text{NOR}}$ gate (Inverter OR gate) 128, the output of which represents a shift register clear pulse which is input to terminal 74-8 of dual flip-flop 74. The shift register clear pulse is inverted by inverter 130 and input to the clear input terminal 74-1 of dual flip-flop 74, which will be described in more detail hereinafter.

Decoder initialization pulse 132 is generated as an output of NAND gate 100 in the following manner and is a 50 millisecond wide pulse which is generated at the 54.9th second of each one minute time frame of the time code. The number decoding circuitry for generating decoder initialization pulse 132 is illustrated in FIG. 2B. NAND gate 100 receives as one input the 10 Hz output of divider 88, and the outputs of NOR gates 134, 136. NOR gate 136 receives as one input the B output of divider 94 and respective outputs from NAND gates 138, 140. NOR gate 134 in turn receives the B and D outputs of divider 96 and the A output of divider 94. NAND gate 138 receives the D and A outputs of divider 92 and the output of NOR gate 142. NAND gate 140 receives the A and C outputs of divider 96 as well as the C output of divider 94. Finally, NOR gate 142 receives the B and C outputs of divider 92 and the D output of divider 94. From the aforedescribed number decoding circuitry, decoder initialization pulse 132 is generated once each minute of the time code and specifically at the 54.9th second of the time code with zero time being defined from the first seconds pulse in the time code. Or in other words, decoder initialization pulse occurs during the 55.9th second of the time code when consideration is given to the 1.03 second hole.

One-half of dual flip-flop 74 comprises a first stage of a shift register (to be more fully described hereinafter) and the first stage of a comparator clock. Terminals 74-4 and 16 respectively comprise the J and K inputs of the comparator clock. The fofollowing are the functions of the comparator clock terminals: Terminal 74-2 is the set input; terminal 74-1 is the clock input; terminal 74-3 is the clear input; terminals 74-14 and 15 are the $\overline{Q}$ and Q outputs, respectively; and terminals 74-5 and 13 are respectively the plus 5 volt VCC and ground. The purpose of the comparator clock in dual flip-flop 74 is to provide signals for controlling second stage comparator clock 150, which in turn provides latch control signals the purpose and function of which will be more fully described hereinafter. As is apparent from FIG. 2A, the J input of the comparator clock is grounded and the K input is connected to plus 5 volts. The clock input to terminal 74-1 is received from the output of inverter 130 which is the previously described shift register clear pulse 122. The output of inverter 130 is provided to terminal 152 to function as a shift register reset pulse, the function of which will be more fully described hereinafter. The reset pulse to terminal 74-2 of the comparator clock is the inverted output of inverter 154, the input of which is the second radio enable pulse (2nd REP) 156, which is generated in a manner to be described hereinafter. The Q output of comparator clock at terminal 74-15 provides an inhibit function and is fed to NOR gate 158 along with the previously described shift register clear pulse. The inhibit pulse from terminal 74-15 prevents the second stage comparator clock 150 from clearing. In the absence of the inhibit pulse, NOR gate 158 provides an output to $\overline{\text{NOR}}$ gate (Inverter OR gate) 160 to provide a clear pulse to the comparator clock second stage 150. $\overline{\text{NOR}}$ gate 160 also receives a third ratio enable pulse (3rd REP) which also provides a clear pulse to comparator clock second stage 150. The generation of the third radio enable pulse is described more fully hereinafter.

A delay network comprising resistor 162 and capacitor 164 is connected to the $\overline{Q}$ terminal 74-14 of the comparator clock to provide an internal delay to prevent the first stage comparator clock in dual flip-flop 74 from switching its state after it has been set by the 2nd REP and the subsequent indication of the presence of a hole, which is made known to the first stage comparator clock by means of the output of $\overline{\text{NOR}}$ gate 128 which is inverted by inverter 130. Thus, the delay network comprising resistor 162 and capacitor 164 prevents the first comparator clock stage from switching whenever a 2nd REP has been received at set input terminal 74-2. This in turn prevents a clear pulse from being generated which would clear second stage comparator clock 150.

The other section of dual flip-flop 74 is the first stage of a shift register which receives the data inputs, which respectively comprise the J and K inputs of the first shift register, at terminals 74-9 and 74-12 from terminals 64-4 and 64-13 of the data sampling section of dual flip-flop 64. The previously described shift register clear pulse is provided to clear input 74-8 and a clock pulse 166 is input to clock input 74-6. Clock pulse 166 is the output of inverter 168 (FIG. 2B) which is generated from the output of NAND gate 96 and represents a 50 milliseconds pulse width shift key clock pulse for shifting the shift register. The Q output appears at terminal 74-11 and is provided to the second stage of the shift register via terminal 170.

The function of the second stage comparator clock 150 is to generate latch control signals at terminal 172 which are the output of NAND gate 174. NAND gate 174 receives the $\overline{Q}$ output from terminals 150-14 of dual flip-flop 150 and an input of 2nd REP 156. The presence of no time code is indicated by light emitting diode 196 which is connected to the Q terminal of second stage comparator clock 150 via resistor 198. The Q output of second stage comparator clock 150 is also provided as an input to NAND gate 200, which also receives 2nd REP 156 and comparator pulse (the generation of which will be described more fully hereinafter) 202 as its other inputs to generate 3rd REP output 204.

Figure 2C:
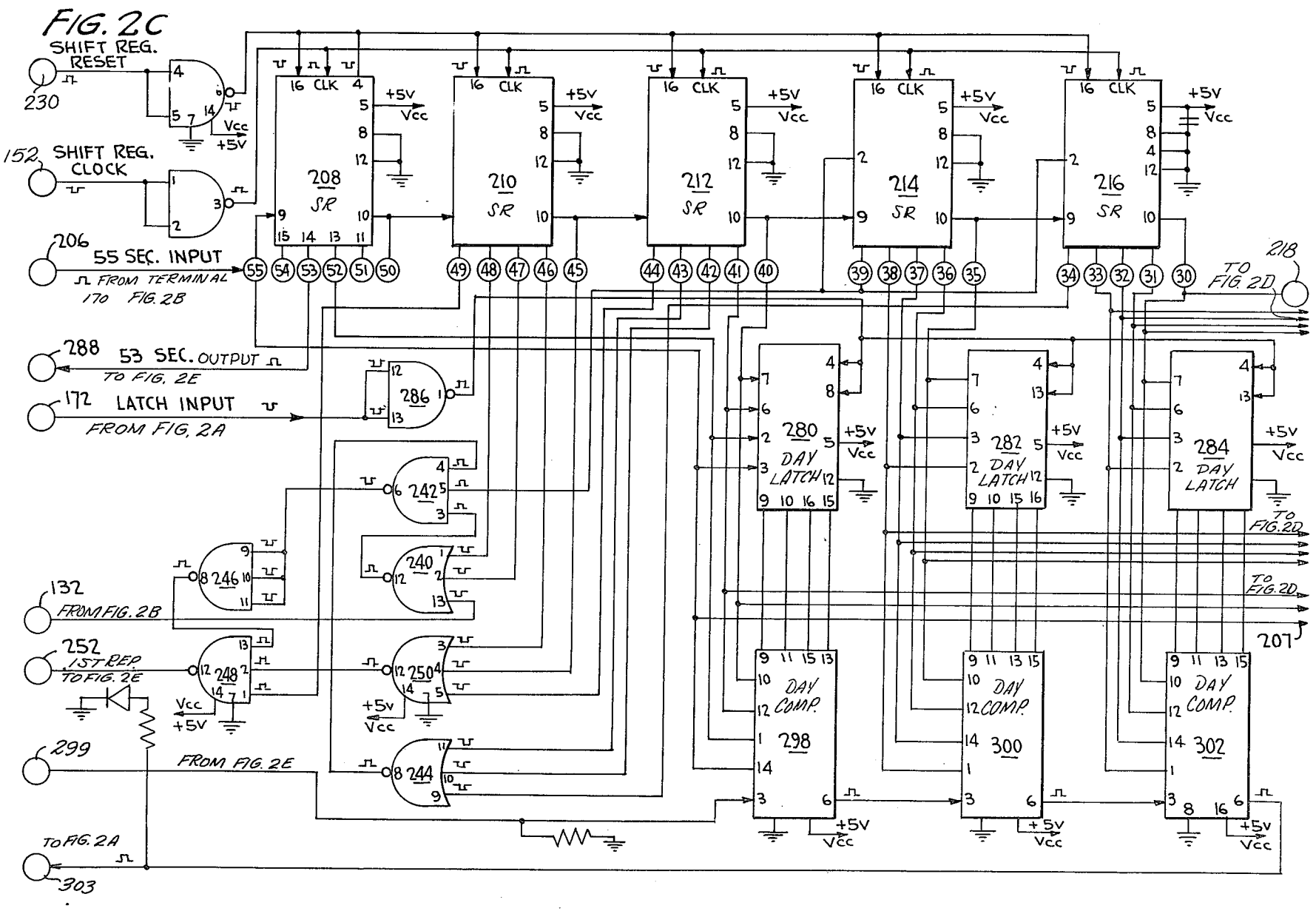
Figure 2D:
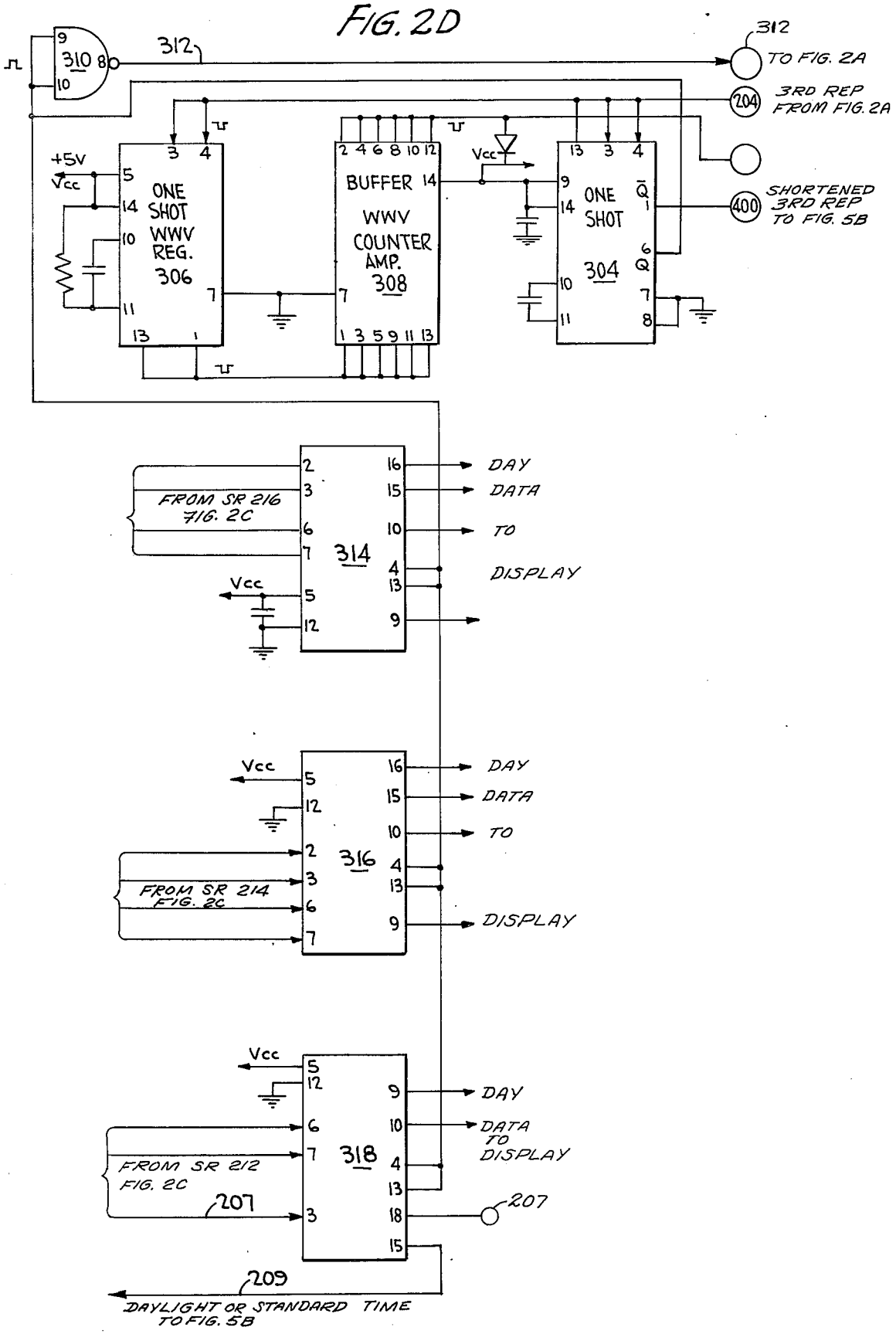
Figure 2E:
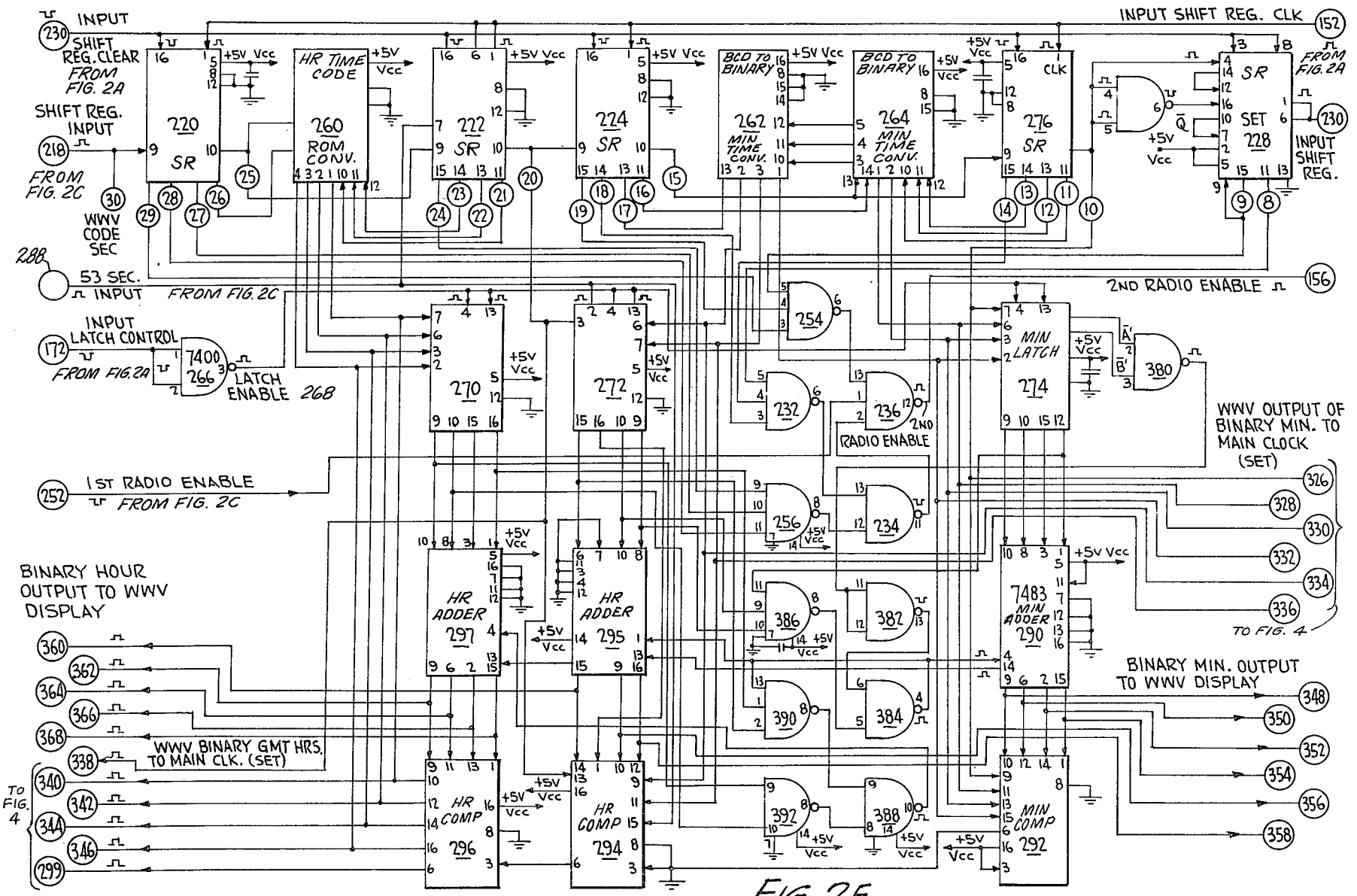

The other stages of the shift register are illustrated in FIGS. 2C, 2D, 2E. Shift register output 170 from the first stage shift register in dual flip-flop 74 is provided at terminal 206 and input to terminal 208 of second stage shift register 208-96. Second stage shift register 208 comprises five sections, each having outputs 50-54 at terminals 208-10 to 15. The output of 208-50 is input to third stage shift register 210. In a similar manner the output of third stage shift register 210 is input to shift register 212; the output of shift register 212 is input to shift register 214; and the output of shift register 214 is in turn provided to shift register 216. Each of shift registers 208 to 216 comprises five sections having outputs which are respectively designated by 50 to 54; 45 to 49 40 to 44; 35 to 30, and 30 to 39. The output 30 of shift register 216 is provided at terminal 218 of FIG. 2E. The remaining shift register stages are illustrated in FIG. 2E. The shift register output 216-30 is input to terminal 220-9 of shift register 220. Shift registers 222, 224, 226 are respectively interconnected as illustrated in FIG. 2E. Each of shift registers 220, 222, 224 and 226 are five-section registers having respective outputs 220-25 to 29; 222-20 to 24; 224-15, to 19; and 226-10 to 14. Shift register 228 is a two-section register having respective outputs 228-8, 9.

Thus, the detected and decoded data information in the WWV time code, which appears at the Q and $\overline{Q}$ terminals 64-13 and 64-4 of the time code detector section of dual flip-flop 64 (FIG. 2A) are shifted into the first shift register stage of dual flip-flop 74 and in a manner well known to those skilled in the art shifted successively into shift registers 208, 210, 212, 214, 216, 220, 222, 224, 226 and 228.

Registers 208 to 228 are controlled by positive shift register reset signals 152 and the negative shift register clear pulse signals 230 (FIGS. 2A, 2C and 26). Shift registers 228 detects and passes binary "zeros" in the first nine seconds position of the WWV time code. Should a binary "1" occur in the first nine positions of the time code, it would indicate that the code format was incorrect, whereby the $\overline{Q}$ output at terminal 228-10 which is input to the set input at terminal 228-7 causes the Q output at terminal 228-11 to be high and latched. That high Q output from terminal 228-11 is input to NOR gate 232, which deactivates that gate, NAND gate 234 and NOR gate 236 thereby disabling 2nd REP pulse 156, which resets the entire decoder apparatus by conditioning the comparator clock section of dual flip-flop 74 to be reset by the detection of the hole in the next succeeding minute of time code data from the $\overline{Q}$ output of re-triggerable dual flip-flop 64 (FIG. 2A). Shift registers 208-228 are then reset by means of the shift register reset pulse 152 which is generated by means of OR gate 128 and inverter 130, which were previously described.

The decoder initialization pulse 132 (FIG. 2B) sets the master clock and the GMT clock (to be described hereinafter) on time. Decoder initialization pulse 132 begins a code format examination procedure. With respect to FIG. 2C the decoder initialization pulse 132 is input to NOR gate 240, which also receives the forty-seventh and forty-eighth second pulse code from the output of shift register 210. The output of NOR gate 240 is input to NAND gate 242 which detects the $P_4$ pulse in the time code. The $P_4$ pulse, the thirty-ninth pulse in the time code (reference FIG. 1) is output from shift register 214 to NAND gate 242. The other input to NAND gate 242 is the output of NOR gate 244 which receives respective inputs of the thirty-fourth, forty-second, and forty-third "seconds" pulses in the time code. The thirty-fourth "seconds" pulse is output from shift register 216 and the forty-second and forty-third "seconds" pulses are output from shift register 212. The output of NAND gate 242 is input to inverter 246 (a NAND gate with three common inputs). The output of inverter 246 is one input to NAND gate 248. The $P_5$ pulse from the time code (the forty-ninth "seconds" pulse in the time code) is output from shift register 210 as one input to NAND gate 248. The remaining input to NAND gate 248 is the output of NOR gate 250, which receives as respective inputs the forty-fourth, forty-fifth and forty-sixth "seconds" pulses in the time code. The forty-fourth "seconds" pulse is output from shift register 212 and the forty-fifth and forty-sixth "seconds" pulses are output from shift register 210. The output of NAND gate 248 is a first radio enable pulse (1st REP) 252, which has a pulse width of 50 milliseconds. If the time code format stored in the respective shift registers are incorrect, 1st REP 252 is not generated by the number decoding logic just described.

1st REP 252 is supplied as an input to previously described NOR gate 236 (FIG. 2E) in order to generate 2nd REP 156 from the output of NOR gate 236 in the following manner. The presence of 2nd REP 156 is a preliminary indication that a correct code format has been received and detected.

Continuing with FIG. 2E, NAND gate 254 checks for the presence of the $P_1$, $P_2$ and $P_3$ pulses in the time code and that those pulses are stored in the correct positions in the shift registers. The presence of a pulse $P_1$ is input from shift register 228; the presence of a $P_2$ pulse is input from shift register 224 and the presence of a pulse $P_3$ is input from shift register 220 to NAND gate 254. The presence of $P_1$, $P_2$ and $P_3$ provides an output of NAND gate 254 as an input to NOR gate 236. The remaining input to NOR gate 236 is generated by NAND gate 234 which receives respective inputs from NOR gate 232, 256. One input to NOR gate 232 is the previously described Q output from terminal 228-11 of shift register 228. The remaining two inputs to NOR gate 232 comprise the presence of the fourteenth "seconds" pulse from shift register 226 and the presence of the eighteenth "seconds" pulse from shift register 224. The presence of all three pulses at the input to NOR gate 232 provides a correct input to NAND gate 234. The three inputs to NOR gate 256 comprise the presence of the nineteenth "seconds" pulse from shift register 224, the presence of the twenty-second "seconds" pulse from shift register 220; and finally the presence of the twenty-eighth "seconds" pulse from shift register 220. Reference to the time code in FIG. 1 indicates that the twenty-fourth, twenty-seventh and twenty-eighth "seconds" pulses represent binary "0's". The true inputs to NOR gate 256 generate an output therefrom which comprises the other input to NAND gate 234. The output of NAND gate 234 comprises one of the three inputs to previously described NOR gate 236. The presence of a true output from NAND gate 254, 1st REP 156 and the true output from NAND gate 234 at the input of NOR gate 236 generates 2nd REP 156, which is an indication that the received and detected WWV time code is probably correct. The presence of 2nd REP 156 can be visually observed by actuating a light emitting diode in a manner well known to those skilled in the art.

2nd REP 156 is now used to generate the latch control signal for storing the time code present in shift registers 208 to 228 in the following manner. 2nd REP 156 is input to the clock input at terminal 150-1 of comparator clock 150 and also comprises one of the inputs to NAND gate 174 (FIG. 2A). A true output from $\bar{Q}$ of comparator clock 150 will condition NAND gate 174 to provide a latch control pulse 172.

The hour and minute time code information is stored in the previously described shift registers in a binary coded decimal code. The hour time code data in pulse positions 20 to 24 and 25, 26 is converted to binary information by hour BCD-to-binary converter 260 (FIG. 2A), which is a read only memory (ROM) converter. The hour time code data is input to ROM 260 from shift registers 220, 222 as indicated in FIG. 2E. In a similar manner the minute time code data from pulse positions 10 to 13 and 15 to 17 (reference FIG. 1) is converted into binary data by means of minute BCD-to-binary converters 262, 264, which respectively receive the minute time code information stored in shift registers 224 and 226 as indicated in FIG. 2E Latch control pulse 172 is inverted by inverter 266 to provide a latch enable output 268 which enables latches 270, 272, 274 to receive the converted hour and minute data previously described. Specifically, the binary hour data from BCD-to-binary converter 260 is transferred into latch 270; the least significant digit in time position twenty of the hour code is transferred to latch 272; and the converted minute time code data from BCD-to-binary converter 262 is transferred to latch 272 and 274; and the converted minute data from BCD-to-binary converter 264 is transferred to latch 274 as indicated in FIG. 2E. Reference to FIG. 1 indicates that the fifty-third second in the time code is a variable bit and that bit 53 is transferred to latch 272 along with the previously described hour and minute data. The hour and minute time code data is converted from binary coded decimal to binary information for the reason that the hour and minute time data information will be updated to account for a subsequent decoding cycle to provide an additional confirmation of the WWV time code in a successive time period. The circuitry for the binary adders is less complex than adder circuitry using binary coded decimal information.

With respect to FIG. 2C, the day information in positions 30 to 34 and 36 to 39 and 40, 41 of the time code (reference FIG. 1) is transferred to latches 280, 282, 284 from shift registers 208, 212, 214 and 216 by the latch control pulse 172 which is inverted by inverter 286. The variable data information for daylight saving time which appears in the fifty-fifth second of the time code is input at terminal 206 and transferred to latch 280 simultaneously with the transfer of daylight information into that latch because, as previously described, latch control pulse 172 is generated from 2nd REP 156.

Because of noise disturbances in the high frequency transmission of the WWV time code, which may cause false information in the variable data time code positions, it is necessary to provide an additional confirmation of the time code format. This is accomplished by the decoder apparatus of this invention in the following manner. The time code confirmation may be accomplished by detecting the variable time code information in a subsequent 1 minute time frame. The additional time frame may, for example, be the next successive one minute time frame, or any successive occurring one minute time frame. For the purpose of the present description, the next successive one minute time frame is selected. The minute data transferred to latch 274 is input to adder 290 and to that minute data is added one minute to update the previously stored minute time code information. The previously described inhibiting of comparator clock 150 prevents the transferred time code data from being dropped or lost. Also, as previously described, the occurrence of the 2nd REP conditioned comparator clock 150 so that the reception of the next subsequent hole at the beginning of a new one minute time frame will cause the detector apparatus to recycle. Thus, the previously described decoder circuitry will function to detect the next subsequent one minute time frame in exactly the same manner as previously described. The variable time code data in that one minute time frame will be stored in storage registers 208 to 228 as previously described.

The new time code in the next subsequent frame advances to the fifty-fifth second and the variable time data in the new time code is stored in storage registers 208 to 228 in the same manner as previously described. Comparator 292 compares the variable minute data in the second of new time code with the 1 minute updated minute information in adder 290. The hour data in the new time code is compared in comparators 294, 296 with the hour data from the previous time code in adders 295, 297 (which is updated if necessary as will be described hereinafter). A true comparison A = B of the minute and hour comparison is transmitted from terminal 299 and provided as an input to day comparator 298 (FIG. 2C). Day comparators 298, 300, 302 compare the day information from the previous time code which has been transferred to latches 280, 282, 284 and a true comparison A = B is output from comparator 302 as output 303 and input to NAND gate 200 (FIG. 2A). The generation of the 2nd REP in the new time code generates a 3rd REP from NAND gate 200 when the $\overline{Q}$ output of comparator clock 150 is high and the comparator output 303 is true, that is A = B.

3rd REP 204 is fifty milliseconds wide and is narrowed to a pulse of 10 microseconds for the purpose of providing the following control function. 3rd REP 204 for the new time code is input to one-shot multivibrator 304 (FIG. 20 Multivibrator 304 has positive and negative going pulse outputs of 10 microsecond pulse widths which are respectively obtained from the Q and $\overline{Q}$ outputs of the multivibrator. The Q output of multivibrator 304 is input to multivibrator 306, which generates a 400 millisecond output pulse for the purpose of controlling buffer 308 which provides control signals to an electromechanical counter which visually displays the number of time frame updates so that the operator of the equipment will be able to determine whether the equipment is operating correctly and the actual number of updates in any given period of time.

The Q output of multivibrator 304 is also input to inverter driver 310 and the output 312 thereof is input to $\overline{\text{NOR}}$ gate 160 (Inverter OR gate) (FIG. 2A) for the purpose of generating a counter clear pulse for comparator clock 150 which thereby conditions the comparator clock to receive the next subsequent time frame data.

The 10 microsecond 3rd REP output from multivibrator 304 is also used as a control pulse to transfer the new time code day information from the respective outputs of shift registers 212, 214 and 216 into day latches 314, 316 and 318 as illustrated in FIG. 2D. Manually controlled data switches may be manually operated by a multiple position switch, one position of which will transfer the day information stored in latches 314, 316 and 318 to a display device. In another position of the multiple data switches, the second data from the main clock may be, for example, transmitted to a visual display device.

The shortened ten microsecond 3rd REP 400 from the $\overline{Q}$ output of multivibrator 304 is used by the main clock circuitry (to be described hereinafter) to transmit the binary hour and minute data from the respective BCD-to-binary converters 260, 262, 264 into the main clock. The binary minute output data appears at terminals 326, 328, 330, 332, 334, 336 at the right-hand side of FIG. 2E; and the binary hour data appears at terminals 338, 340, 342, 344 and 346 at the lower left-hand corner of FIG. 2E. Binary minute output for display purposes appears at terminal 348 to 358; and the binary hour output for display purposes appears at terminals 360 to 368.

The 3rd REP which cleared comparator clock counter 150 provides a high logic signal at the $\overline{Q}$ output of comparator clock 150, and that high output along with 2nd REP 156 conditions NAND gate 174 to generate a new latch control pulse 172, which transfers the data stored in the storage registers as previously described with respect to the first time code data.

The variable binary data in the fifty-fifth second of the WWV time code which represents daylight saving time information (control function No. 6 reference FIG. 1) is input at terminal 206 to day comparator 298 where it is compared with the fifty-fifth second data in the previous time frame. (FIG. 2C) The variable daylight saving time data is also input at terminal 207 of FIG. 2D and transferred into latch 318. During the daylight time of the year, control function No. 6 is a binary "1" and during the standard time of the year, control function No. 6 is a binary "0" and that variable binary information appears as an output at terminal 209 in FIG. 2D where it is transmitted to the advance standard time card circuitry to be described hereinafter.

The following is a description of the sixtieth minute and twenty-fourth hour detectors illustrated in FIG. 2E which are used to respectively update minute adder 290 and hour adder 297. The $\overline{A}$ and $\overline{B}$ outputs from latch 274 are input to NOR gate 380, the output of which is input to inverter 382 to provide an input to NOR gate 384. NOR gate 384 detects the fifty-ninth minute. The other input to NOR gate 384 is the output of NAND gate 386 which has respective inputs from the D′ output of latch 274 and the E′ and F′ outputs of latch 272. The output of NOR gate 384 is input to minute adder 290 to add 4 minutes to the minute count therein, which is necessary since adder 290 is a binary adder which counts up to 64. Thus, the addition of four minutes to adder 290 at the detection of the fifty-ninth minute will carry that adder to a zero minute output. The output of NOR gate 384 is also input to hour adder 295 to carry over the one hour data information output in that adder. The outputs A′ to F′ have the respective binary weights 1–64.

NOR gate 388 receives respective inputs from NAND gates 390, 392 to detect the twenty-third hour. The output of NOR gate 384, which detects the fifty-ninth minute, is provided as one input to NAND gate 390. The A′ and E′ outputs of hour latches 272, 270, respectively, provide the other two inputs to NAND gate 390. NAND gate 392 receives the B′ and C′ outputs of hour latch 270. The output of NOR gate 388 is input to hour adder 297 to add eight hours to the hour output thereof to make the output of adder 297 zero hours, for the same reason that the four minute count was added to minute adder 290.

MAIN UTC PRESETTABLE CLOCK

With respect to FIG. 4 the 1920 Hz input is obtained from the 1920 Hz divider 196 of FIG. 4 in the previously mentioned U.S. patent application and is used to drive a pair of dividers 402, 404, which are serially connected to divide by 192, thereby providing a 10 Hz output. Dividers 402, 404 provide a means for advancing the seconds count to correct for the WWV signal propagation delay, which will vary in accordance with the location of the decoder receiver. The propagation delay will be substantially constant for a given location of the decoder receiver and consequently the milliseconds advance necessary to be inserted into dividers 402, 404 is a fixed amount for each decoder receiver. The WWV delay milliseconds advance 406 is inserted to preset each of dividers 402, 404. Divider 402 divides the 1920 Hz input pulses by sixteen to generate a 120 Hz pulse output at terminal 402-12 which is input to divider 404 at terminal 404-8. Divider 404 divides the 120 Hz pulse input by twelve to obtain the 10 Hz output.

Dividers 402, 404 are cleared by a one hundred ninetytwo pulse detector which comprises NAND gate 408 to which is input the two most significant pulse information from divider 404. The output of NAND gate 408 is input to OR gate 410 and inverted by inverter 412 and provided to the clear inputs of dividers 402, 404 as indicated in FIG. 4. The 10 Hz output from NAND gate 408 is input to divider 414 which divides the 10 hz by ten to 1 hz which is input to one-shot multivibrator 416 via terminal 416-3 and 4. The Q output of multivibrator 416 is one pulse per second and has a pulse width of 10 microseconds. The one pulse per second signal 418 is used to initiate the trace on an oscilloscope for the purpose of accurately determining the WWV delay and the number of milliseconds advance 406 which is used to preset dividers 402, 404.

Pulse signal 418 is input to serially connected dividers 420, 422 to provide an overall divide by sixty function to generate the binary seconds outputs at terminals 424, 426, 428, 430, 432, 434.

The chain of dividers, just described, namely dividers 402, 404, 414, 420 and 422 are enabled by 3rd REP 400 which is obtained from the $\bar{Q}$ output of multivibrator 304 (reference FIG. 2D). However, the decoder apparatus of this invention also provides a feature whereby the seconds, minutes and hours can be manually set. The seconds are manually set by pushbutton switch 436 which is depressed and held until the actual time of zero seconds, which is indicated by an audio beep in the WWV transmission. NAND gates 438, 440 are interconnected as an anti-bounce flip-flop to prevent a multiple input to the second dividers. The output of NAND gate 440 is input to Inverter OR gate 410 and inverted by inverter 412 to clear dividers 402, 404. The output of NAND gate 440 is also input to Inverter OR gate 442 to reset divider 414. Multivibrator 416 is also reset by the output of NAND gate 440. Dividers 420, 422 are cleared by a clear pulse from inverter 444 to which is input the output of Inverter OR gate 446, which in turn receives, as one input, the output of NAND gate 440.

A one pulse per minute signal 448 for controlling the minutes clocking is generated by a sixty second detector 450 which comprises a four input NAND gate connected to the binary 4, 8, 16 and 32 outputs of dividers 420, 422. The output of detector 450 is also used as a clear pulse to clear dividers 420, 422 by means of Inverter OR gate 446 and inverter 444. The output of detector 450 is input to multivibrator 452 to generate the one pulse per minute signal 448, which is used in the advance index circuitry 202 of FIG. 4 of the previously mentioned U.S. application. One pulse per minute signal 448 is input to OR gate 454, the output of which is input to series connected minute counters 456, 458. Counters 456, 458 are enabled by 3rd REP 400 to preset counters 456, 458 with the WWV time code binary minute data on terminals 326 to 336 of FIG. 2E as previously described. The output of counters 456, 458 is provided at terminals 460, 462, 464, 466, 468 and 470. Minutes counters 456, 458 are cleared by sixty minute detector 472, which comprises a NAND gate the inputs of which are the binary 4, 8, 16 and 32 outputs of dividers 456, 458.

In a manner similar to that previously described with respect to the binary seconds generation, the binary minutes can also be updated manually by pushbutton switch 474 which provides an output through anti-bounce flip-flop 476 to Inverter OR gate 454, the output of which is input to counter 456. The primary difference between the minutes manual set addition and the seconds manual set addition is that in the former case pushbutton 474 is not held and each switching thereof causes a one minute addition to counter 456. One pulse/hour output signal 478 is generated from counters 456, 458 by 60 minute detector 472, previously described.

The pulse output 480 representing the fifty-ninth minute is detected by six-input NAND gate 482 which is connected to the outputs of counters 456, 458 as indicated in FIG. 4. Inverter 484 provides the necessary inversion of the binary "4" output of counter 456 for the operation of NAND gate 482 to detect the fifty-ninth minute.

One pulse/hour signal 478 is input to hour counter 486 through OR gate 488. Hour counter 490 is serially connected to hour counter 486 to generate the binary hour outputs at terminals 492, 494, 496, 498 and 500. Hour counters 486, 490 are preset with the WWV binary hour data from terminals 338 to 346 (reference FIG. 2E) and that data information is preset into hour counters 486, 490 by 3rd REP 400.

Hour counters 486, 490 can also be manually set by means of pushbutton switch 502 which generates a one pulse input to counter 486 through anti-bounce flip-flop 504 and Inverter OR gate 488. Each depression of pushbutton switch 502 generates a one pulse input to hour counter 486. Hour counters 486, 490 are reset by detecting the twenty-fourth hour using NAND gate 506 which receives as inputs the binary "8" and binary "16" outputs of hour counter 490. The output of NAND gate 506 also provides a zero hour setting pulse for GMT time at terminal 508.

The binary hour output on terminals 492 to 500 are input to GMT local 12/24 hour conversion circuit 86 in the above mentioned U.S. application. The binary seconds outputs from the main clock at terminals 424 to 434 are provided to binary seconds monitor 92 and the seconds remote equipment shift register 98 of the circuitry in the aforementioned U.S. application. Finally, the binary minute outputs from terminals 460 to 470 are provided to the hour advance index logic 70, the minute advance index logic and the minute binary monitor 90 of the circuitry in the aforementioned U.S. application.

ADVANCE STANDARD TIME CIRCUITRY

Figure 5A:
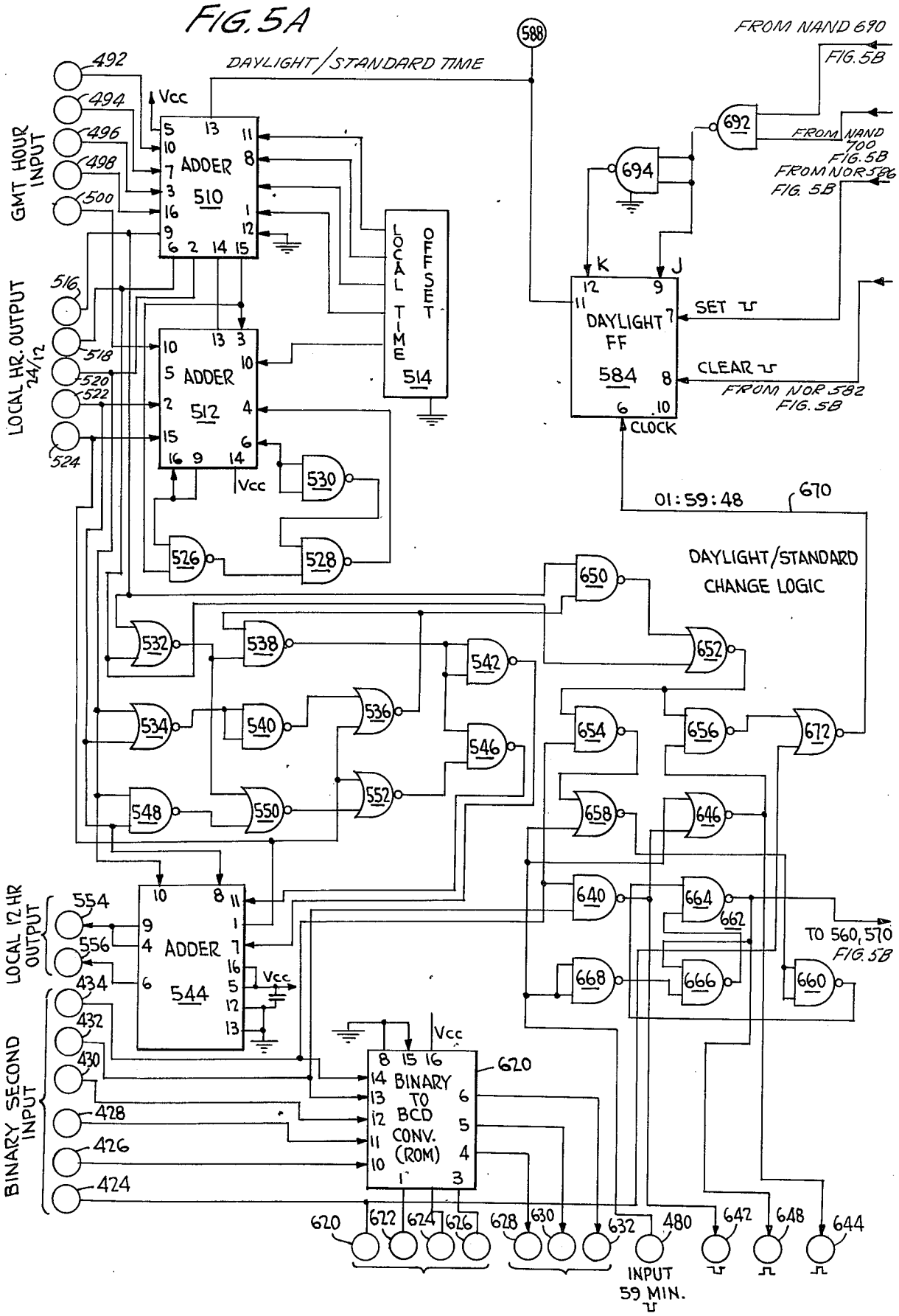
FIGS. 5A, B are schematic diagrams of an advanced standard time circuit of the present invention.

The following is a description of the advance standard time circuitry illustrated in FIGS. 5A, B. The advance standard time circuitry converts the GMT hour to local 24 hour or local 12 hour time. Because adder circuitry is used in the conversion from GMT to local hour time it is necessary to add nineteen hours for a 5 hour negative offset. The negative offset is provided to adders 510, 512 by means of encoder switch 514 which presets each of the adders by the necessary offset, which in the example used for the present description is 19 hours or the equivalent of the Eastern standard time offset. The GMT binary hour data is input to adders 510, 512 from terminals 492 to 500 of the master clock illustrated in FIG. 4. The local twenty four hour time is taken from the output of adders 510, 512 at terminals 516, 518, 520, 522 and 524.

Because adders 510, 512 count to 32, it is necessary to make a special provision to add a count of eight to the adders when the hour data exceeds twenty-three hours. This is accomplished by inputting the eighth binary hour from adder 512 and the carry output from adder 510 to NAND gate 526. The output of NAND gate 526 provides one input to inverter OR gate 528. However, the output of NAND gate 526 is not available for the full period during which adders 510, 512 are counting to 31. Consequently, inverter OR gate 528 is provided with an inverted output from inverter 530 of the carry output at terminal 512-6 of adder 512. This enables the output of inverter OR gate 528 to provide an input to adder 512 which adds a count of eight to that adder, thereby making that adder count to 32. Adder 510 also receives a daylight/standard time input to account for daylight or standard time as the case may be. The daylight input to adder 510 is high for daylight saving time and is low for standard time and is generated by circuitry which will be described more fully hereinafter.

The advanced standard time circuitry also provides a local twelve hour output which is generated from the local 24 hour output in the following manner. Table II illustrates the principle of operation of the 24 hour to 12 hour conversion circuitry. In order to make the conversion the zero hours local time is first detected and twelve hours (4 hours plus 8 hours) is added to obtain the twelfth hour local time. No correction is made for the local 24 hour times of 1 to 12. Local hours 13 to 23 are detected and the binary number 4 added to those hours to obtain the afternoon and evening twelve hour local times. This is necessary because the adder circuitry counts to fifteen and then recycles, thus for example, the thirteenth hour, which is 1:00 P.M. in 12 hour local time requires a count of four so that the adder will count fourteen, fifteen, zero, then one.

With respect to FIG. 5A, NOR gates 532, 534 and 536, NAND gate 538 and inverter 540 detect the zero local hour and function as a five input NOR gate with a inverted output. The output of NAND gate 538 represents the zero hour detection pulse. The output of NAND gate 538 is inverted by inverter 542 and input to adder 544 to add a binary number eight to the hour in adder 544. The zero detection output from NAND gate 538 is input to NAND gate 546 to provide another input to adder 544 to add the number four to the local hour time, which is zero in that adder. Thus, the local 24 hour zero hour is equivalent to 12:00 Noon in 12 local time. For hours 1 to 12 in the local 24 hour time, there is no zero detection output from NAND gate 538 and consequently no corrections are provided to adder 544. Thus, the hours 1:00 A.M. to 12:00 Noon in the twelve hour local time are equivalent to the same hours in the local twenty-four hour time.

The hours 13, 14 and 15 in the local 24 hour time are detected by NOR gate 532 and NAND gate 548 and the respective outputs of NOR gate 532 and NAND gate 548 are input to NOR gate 550. The output of NOR gate 550 represents detection of the thirteenth, fourteenth and fifteenth hours and is input to NOR gate 552, the output of which is input to NAND gate 546 to provide the add-plus-4 hours to adder 544. Thus, the thirteenth, fourteenth and fifteenth hours in the local 24 hour time have been converted to 1:00 P.M., 2:00 P.M. and 3:00 P.M., respectively, in the 12 hour local time.

For hours sixteen through twenty-three, the most significant binary output from adder 512 is input to NOR gate 552 and an add-plus-4 signal is output from NAND gate 546 to add a binary four to the hours in adder 544. Thus, in the foregoing manner the hours zero through 23 in the local 24 hour time are converted to twelve hour local time as indicated in Table II. The local twelve hour time from adder 544 at terminals 554, 556 is provided to hour advance index logic 70 described in FIG. 3 of the previously mentioned U.S. patent.

TABLE II

| Local 24 Hr Clock | Operation | 12 Hr Local Time |
|---|---|---|
| 0 | Detect Zero and add + 12 (8 + 4) | 12 A.M. |
| 1 | No correction | 1 |
| 2 | " | 2 |
| 3 | " | 3 |
| 4 | " | 4 |
| 5 | " | 5 |
| 6 | " | 6 |
| 7 | " | 7 |
| 8 | " | 8 |
| 9 | " | 9 |
| 10 | " | 10 |
| 11 | " | 11 |
| 12 | " | 12 |
| 13 | Detect 13 through 23 and Add + 4 | 1 P.M. |
| 14 | " | 2 |
| 15 | " | 3 |
| 16 | " | 4 |
| 17 | " | 5 |
| 18 | " | 6 |
| 19 | " | 7 |
| 20 | " | 8 |
| 21 | " | 9 |
| 22 | " | 10 |
| 23 | " | 11 |

The following is a description of the decoding apparatus.

The decoding apparatus of this invention includes an alarm feature which provides outputs to indicate that there has been no update of time information and also in the event of start-up of the decoder apparatus. With respect to FIG. 5B, when power is first turned on to the decoder apparatus alarm flip-flops 560, 562 are cleared to condition them for proper operation. The clear signal is provided by a resistor-capacitance network comprising capacitor 566 and resistor 568. The presence of the first 3rd REP 400 (reference FIG. 2D) removes the alarm signal from the Q output of flip-flop 560 by application of the 3rd REP to the set input of flip-flop 570 and 560. 3rd REP 400 is inverted by inverter 572 to clock flip-flop 562 thereby making the Q output at terminal 562-15 thereof high. And that output remains high as long as the power is on. The high Q output removes the alarm signal from terminal 547, which provides a control signal that can be used, for example, to display the time data on suitable display apparatus (not disclosed herein).

Prior to the switching of flip-flop 562 which caused the Q output thereof to go high, the daylight information from terminal 209 of Figure is inverted by inverter 576 and that inverter output provides one input to NOR gate 578. The daylight signal 209 is also input to NOR gate 580. The low Q output of flip-flop 562 is input to the other input of NOR gate 580 and also provides another input to NOR gate 578. A high signal at terminal 209 represents daylight time and a low signal at that terminal represents standard time. Assuming a low level signal at terminal 209, representing standard time, the output of NOR gate 580 is high as both conditions are true at its input and the output of NOR gate 580 is input to inverter OR gate 582 to provide a clear pulse to flip-flop 584 (FIG. 5A). The clear pulse to flip-flop 584 makes the Q output thereof at terminal 584-11 low.

Assuming that the input at terminal 209 represents daylight saving time and is therefore high, that input is inverted by inverter 576 and represents one input to NOR gate 578. The other input of NOR gate 578 is the low Q output of flip-flop 562, thereby resulting in a high output of NOR gate 578 which comprises an input to NOR gate 586 and the output thereof is a set signal applied to flip-flop 584 (FIG. 5A) which causes the Q output thereof to be high. The Q output of flip-flop 584 is then input to adder 510 to add a "one" for daylight saving time and to add a "zero" for standard time. The daylight/standard Q output from flip-flop 584 is also present at terminal 588 which is then provided as an input to hour advance index logic 70 of the previously mentioned U.S. application. The previously described generation of the daylight/standard pulse input to adder 510 only occurs when the Q output of flip-flop 562 is low and when that output is switched high, at the trailing edge of 3rd REP 400, the daylight information at terminal 209 is blocked by the aforedescribed logic.

The daylight or standard mode can also be generated manually in the event that for some reason the WWV time code is not being received. In order for the daylight or standard mode to be manually inserted it is necessary that the Q output of flip-flop 562 be low to condition the previously mentioned NOR gates 578, 580. The manual insertion of the daylight or standard time mode from equipment start-up is obtained as follows. For daylight mode, manual switch 590 is depressed and the output of NAND gate 592 is input to NAND gate 594 to open that gate. The low output of NAND gate 594 is input to NOR gates 596, 598. The other input of NOR gate 596 is obtained from the normally open contact of switch 590 and the other input to NOR gate 598 is obtained from the normally open contact of standard switch 600. Because both the input conditions of NOR gate 596 are true, its output is high and is inverted by inverting OR gate 586 and provided to the set terminal of flip-flop 584 which immediately places the apparatus in the daylight mode.

For the manual insertion of the standard mode, switch 600 is depressed and the high output of NAND gate 602 is input to NOR gate 604 and NAND gate 594. The output of NAND gate 594 provides one input to NOR gate 598 and the other input thereof is obtained from the normally open contact of switch 600. Since both the input conditions to NOR gate 598 are true, its output is high and is provided to inverting OR gate 582, the output of which is then input to clear flip-flop 584, thereby immediately placing the apparatus in the standard mode as previously described with the automatic operation of the daylight/standard mode.

Anti-bounce flip-flops 606, 608 are respectively provided in operative association with daylight switch 590 and standard switch 600 to prevent a multiple signal actuation upon depression of either one of the switches. Anti-bounce flip-flops 606, 608 perform the same functions as described with the same named circuits in the main UTC presettable clock illustrated in FIG. 4.

The alarm at terminal 574 is removed in the manual daylight/standard time mode operation in the following manner. With the depression of the daylight switch 590, the output of NAND gate 592 is input to inverting OR gate 604 and the output thereof provides a reset pulse to flip-flop 562, thereby switching the flip-flop so that its Q output is high. In a similar manner the depression of standard time switch 600 generates an output from NAND gate 602 which is input to inverting OR gate 604 to provide the same reset pulse to flip-flop 562.

The advanced standard time circuitry of FIG. 5A, B can instantaneously be placed in either the daylight or standard mode while the equipment is in operation by manual operation of daylight switch 590 or standard time switch 600. The previously described logic circuitry operating in conjunction with daylight switch 590 and standard time switch 600 is set up to enable either the daylight or standard time mode to be inserted into the advanced standard time circuitry during operation of the equipment. If the daylight mode is to be established, daylight switch 590 is depressed and held in a depressed position while standard switch 600 is momentarily depressed. In a similar manner if standard time is to be inserted, standard time switch 600 is depressed and held depressed while daylight switch 590 is momentarily operated.

Continuing with FIG. 5A, the binary seconds output from terminals 424 to 434 of the main UTC presettable clock of FIG. 4 are input to read only memory (ROM) binary-to-BCD converter 620 and the outputs at terminals 620 to 632 are provided to seconds binary monitor 92 in FIG. 3 of the previously mentioned U.S. Patent.

The following is a description of the daylight/standard change logic for generating the necessary control signal to automatically trigger the switchover at 2:00 A.M. The daylight/standard change logic also generates advance index outputs which are provided to the hour advance index logic 70 and minute advance index logic 76, as well as to the hour remote equipment shift register 94, all of which are illustrated in FIG. 3 and described in the previously mentioned U.S. patent. The binary seconds data at terminals 432 and 434, which correspond to a respective binary weighting of 16 and 32, is input to NAND gate 640 and the output thereof represents the 48 to 60 seconds output at terminal 642 which is provided to the previously mentioned advance index circuitry in the aforesaid U.S. Pat. A 59:48 – 60 (minutes-seconds) output at terminal 644 is generated by NOR gate 646, the inputs of which are the fifty-ninth minute from terminal 480 in the master clock circuitry of FIG. 4 and the output of NAND gate 640.

The 01:59:32 –60 (hour-minute-seconds) output at terminal 648 is generated in the following manner. The O1 hour is detected by NAND gate 650 and NOR gate 652. The zero output from NOR gate 536 (previously described) and the binary one output of adder 510 are input to NAND gate 650 and the output thereof forms one input to NOR gate 652. The other input of NOR gate 652 is the binary two output of adder 510. Thus, the output of NOR gate 652 is the 01 hour local time. The output of NOR gate 652 is input to NAND gates 654, 656. The binary seconds input at terminal 434, which represents a binary weight of thirty-two, provides the other inputs to NAND gate 654. The output of NAND gate 654 forms one input to NOR gate 658. The fifty-ninth minute at terminal 480 from the master clock is input to NOR Gate 658 and the output thereof represents the detection of the 01:59:32 – 49 time. The output of NOR gate 658 is inverted by inverter 660 and latched at 01:59:32 – 49 by latch 662 comprising NAND gates 664 and 666. NAND gates 664 and 666 are connected as a conventionally known latching circuit as illustrated in FIG. 5A. Latch 662 is cleared at the end of the fifty-ninth minute by the output of inverter 668 which inverts the fifty-ninth minute data at terminal 480. The output of NAND gate 664 and latch 662 is provided to terminal 648 from which it is input to the hour remote equipment shift register 94 described in the previously mentioned patent.

Daylight/standard change logic control signal 670 is generated by NOR gate 672, NAND gate 656 as follows. The 01 hour at the output of NOR gate 652 is input to NAND gate 656 along with the 59:48 - 60 output of NOR gate 646. The output of NAND gate 656, which represents 0.1:59:48 - 49 forms one input to NOR gate 672. The other input to NOR gate 672 is the binary seconds input at terminal 424, which has a binary weight of one, and therefore the output of NOR gate 672 is the daylight/standard change logic control signal at the time 01:59:48 and that signal clocks flip-flop 584 at the beginning of the forty-ninth second to insert the daylight or standard time data into adder 510.

Figure 5B:
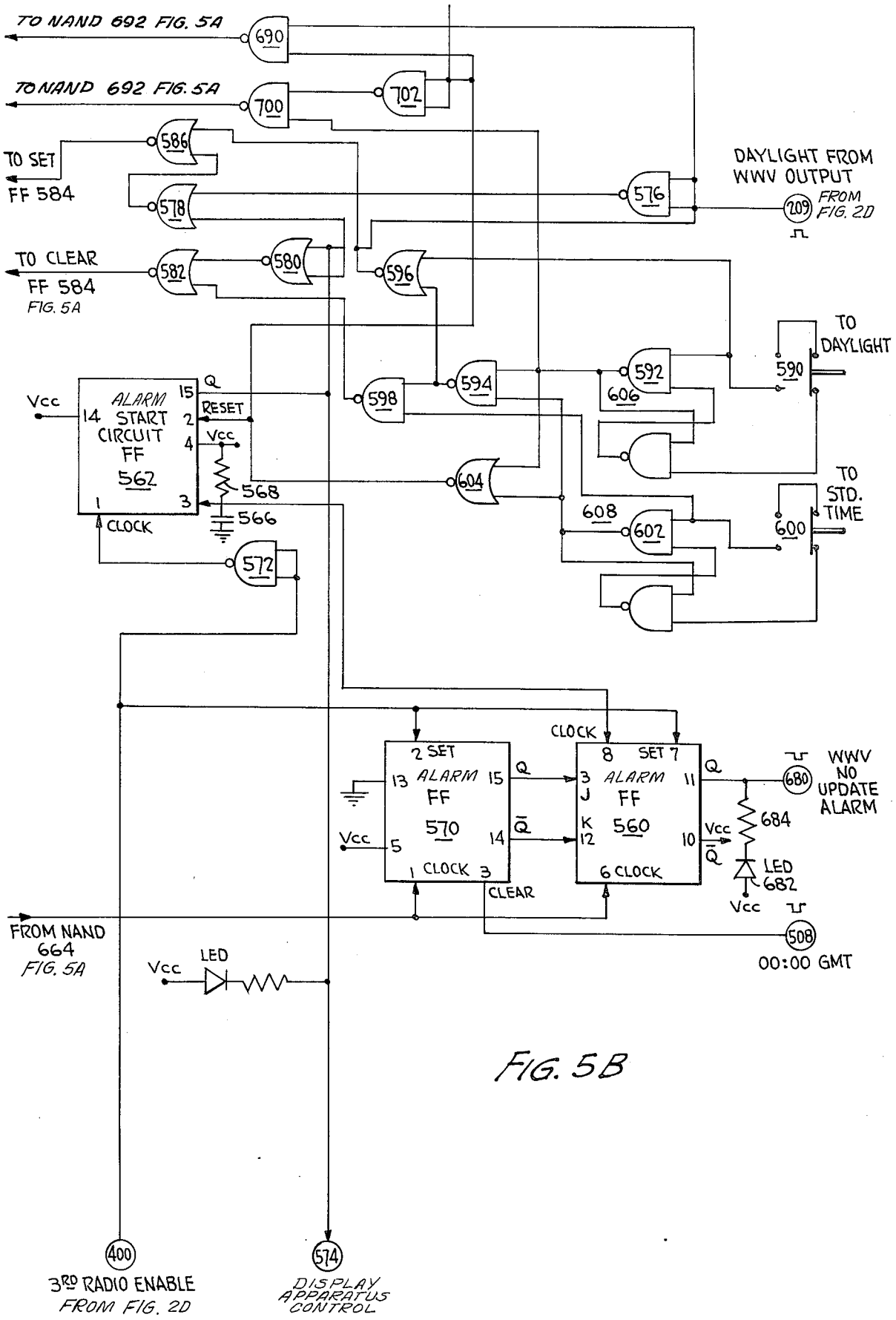

The advanced standard time circuitry of FIG. 5B provides an alarm between the zero hour GMT time and 2:00 A.M. on any day by means of flip-flops 560, 570 in the following manner. The zero hour GMT signal 508 from the master clock illustrated in FIG. 4 clears flip-flop 570. In the event that no update has been received, flip-flops 560, 570 are both clocked by the 01:59:32 - 60 output from NAND gate 664 (previously described with respect to the daylight/standard change logic circuitry). The clock input to flip-flop 560 will switch the Q output thereof low to provide an alarm signal at terminal 680. The alarm signal at terminal 680 can, for example, be used to inform a central office that the decoding apparatus has not received an update between the OO GMT hour and 2:00 A.M. Light emitting diode 682 is connected to the Q output of flip-flop 560 through resistor 684 to provide a visual indication to an operator that no update has been received.

In the event that an update had been received between zero GMT hour and 2:00 A.M., which occurs with the presence of a 3rd REP at terminal 400, the Q output of flip-flop 560 would remain high as the 3rd REP sets flip-flops 560 and 570.

The following is a description of the automatic transfer of the advanced standard time circuitry of FIGS. 5A, 5B into either a daylight or standard time mode at hour 01:59:48. The daylight/standard time input at terminal 209 forms one input of NAND gate 690 and the other input to NAND gate 690 is the output of inverting OR 604, which is normally high.

Thus, a binary "1," indicating a daylight time mode, at terminal 209 provides a true condition for the inputs of NAND gate 690 and the output of that gate is input to OR gate 692, which in turn is provided to inverter 694 and to the J terminal of flip-flop 584. The output of inverter 694 drives the J input of flip-flop 584. Thus, with a high, or daylight time input at terminal 209, flip-flop 584 will generate a high Q output when clocked by the 01:59:48 clocking pulse from the previously described daylight/standard change logic.

In the event that the signal at terminal 209 is low thereby indicating standard time, the input conditions at NAND gate 690 are not true and therefore its output is low and the output of OR gate 692 is low. The low input to the J terminal flip-flop 584 and the inverted high input to the K input of that flip-flop will condition it so that the 01:59:48 clock pulse will switch the Q output to a low level.

The advanced standard time circuitry of FIG. 5B also provides for manual preset of the daylight or standard time mode which will then automatically occur at the time 01:59:48. This preset function can occur up to twenty-four hours in advance of the actual daylight or standard switching. For daylight preset, daylight switch 590 is depressed and locked The resulting high output from NAND gate 592 is input to NAND gate 700. The other input to NAND gate 700 is high by virtue of the inversion of the reset, low output of inverting OR 604 through inverter 702. NAND gate 700 thereby provides the low output which is input to inverting NAND gate 692. The high output of inverting NAND gate 692 then operates in the same manner to condition flip-flop 584 so that the Q output thereof will switch to a high level upon the input of the 01:59:48 clock pulse.

For the manual preset in the standard time mode, standard time switch 600 is depressed and locked. The resulting high output from NAND gate 602, which is converted by inverting OR gate 604 to a low level , inhibits NAND gate 690. Because daylight switch 590 is open, the output of NAND gate 592 is low thereby inhibiting NAND gate 700. The output of inverting NAND gate 692 is therefore low so that flip-flop 584 is conditioned to provide a low Q output with the presence of the clock pulse at 01:59:48.

What is claimed is:

1. Time detecting apparatus, comprising:

means for receiving repetitive binary coded sets of data including time data in a predetermined format;

detecting means for determining from one set of said received data the components thereof representative of time;

storage means for temporarily storing said components;

control means for actuating said detecting means after a preselected time interval to determine from at least one successive set of said received data the components thereof representative of time;

means for updating said stored components by said time interval;

comparison means for comparing the updated stored time components with the time components of said at least one successive set of data;

means responsive to said comparison means for generating signals indicating that said time components from said one set and said at least one successive set of said received data are identical; and means responsive to said signals to read out said updated stored components from said storage means.

2. Time detecting apparatus as in claim 1, wherein said time data include coded identification markers for separating each of said binary coded sets of data;

said-binary coded sets of data including successive minute, hour and day time data;

said predetermined format including a reference pulse preceding each time frame and at least one control function representing daylight saving time information;

said detecting means including reference marker sampling means for establishing a window for detecting the initial reference marker of each time frame; and data marker sampling means for establishing a window for detecting said time data within each of said binary coded sets of data.

3. Time detecting apparatus as in claim 2, wherein said control means further includes shift register and comparator clock means for respectively generating a signal representative of daylight saving time and an inhibit output pulse.

4. Time detecting apparatus as in claim 2 wherein said control means includes reference sampling logic circuitry including means for generating a constant frequency clock pulse, divider means responsive to said clock pulses and logic circuitry responsive to said divided clock pulses for generating a reference sampling gate pulse defining said window; and data sampling logic circuitry including divider circuitry responsive to said clock pulses and logic circuitry responsive to the divided clock pulses for successively generating data sampling gate pulses representing said data sampling window; and said reference marker sampling means and said data marker sampling means respectively generating reference pulse outputs representing said coded identification markers and data pulse outputs representing said time data.

5. Time detecting apparatus as in claim 4, wherein said storage means includes a number of shift registers for storing said reference pulse outputs and said data pulse outputs and said control means further includes means responsive to the data stored within said storage means for generating a first radio enable pulse (first REP) from selected ones of said stored code identification markers, said first REP indicating detection and storage of a complete set of said time data.

6. Time detecting apparatus as in claim 5, wherein said control means further includes means for generating a second radio enable pulse (2nd REP) from said first REP pulse and selected ones of said stored reference pulse outputs and said stored data pulse outputs, said 2nd REP indicating a probably correct code.

7. Time detecting apparatus as in claim 6, wherein said comparison means includes comparator clock counter means responsive to said 2nd REP for generating a third radio enable pulse (3rd REP) indicating identity between comparison of said time components from said one set of data and said at least one successive set of data and also for generating latch control pulses.

8. Time detecting apparatus as in claim 4, wherein said control means further includes means for generating a decoder initialization pulse for actuating said detecting means in a subsequent time frame, said decoder initialization pulse being generated from data pulses in a selected one of said code groups, said decoder initialization pulse means being responsive to said divider means.

9. Time detecting apparatus as in claim 7, further comprising means for generating shift register clock and reset pulses from a main clock for controlling said number of shift registers;

and said read out means including hour time code converter circuitry, minute time code converter circuitry and day time code converter circuitry responsive to selected ones of said plurality of shift registers for respectively generating hour, minute and day time signal outputs;

hour latch circuits, minute latch circuits, and day latch circuits for respectively temporarily storing the information in said hour time code converter, minute time code converter circuitry and day time converter code circuitry, and being responsive to said latch control pulses;

and said time detecting apparatus further comprising terminal means connected to selected ones of said minute time code converter outputs and said hour time code converter outputs for providing binary minute and hour data for setting digital clocks.

10. Time detecting apparatus as in claim 9, further comprising hour adder circuits and minute adder circuits respectively responsive to the hour and minute data stored in said hour latch and minute latch circuitry, said hour adder circuits being responsive to said minute adder circuits, said hour and minute adder circuits being binary adders; and said means for updating including means for detecting the 59th minute to add a predetermined count to said minute adder circuitry and means for detecting the 23rd hour to add a predetermined count to said hour adder circuitry.

11. Time detecting apparatus as in claim 10, wherein said hour adder and said minute adder circuits respectively provide binary hour and binary minute outputs for display purposes.

12. Time detecting apparatus as in claim 10, wherein said comparison means includes hour comparator circuitry and minute comparator circuitry respectively responsive to said hour adder circuitry and said minute adder circuitry, said hour comparator circuits providing binary GMT output signals for setting digital clocks.

13. Time detecting apparatus as in claim 9, wherein said binary coded sets of data are transmitted by radio signals and said time detecting apparatus is located at a known distance from the point of transmission of said coded sets of data and further comprising means for providing a signal representative of the transmission delay of said binary coded sets of data and responsive to said third REP pulse and said main clock.

14. Time detecting apparatus as in claim 13, further comprising divider means responsive to said transmission delay signal for generating binary coded decimal seconds signals;

multivibrator means responsive to said BCD seconds signals to generate a one pulse per second output;

divider means responsive to said one pulse per second output signal for generating a one pulse per minute signal;

minute counter circuitry responsive to said third REP and said binary minute data for generating binary minute output data and hour counter circuitry for generating binary hour output data;

means responsive to said minute counter outputs for detecting the 59th minute and means for detecting the 60th minute to generate a one pulse per hour output signal.

15. Time detecting apparatus as in claim 14, further comprising means responsive to said 1 pulse per second output for manually inserting additional seconds information into said divider means for producing said binary seconds output, means responsive to said 1 pulse per minute signal for manually inserting minutes data into said minute counters, and means responsive to said one pulse per hour signal for manually inserting hour data into said hour counter circuitry.

16. Time detecting apparatus as in claim 13, further comprising hour counter circuits responsive to said binary hour data for generating binary hour output data and means for generating a signal representing zero GMT time.

17. Time detecting apparatus as in claim 13, further comprising means for converting GMT hour time data into local hour time data including means for generating local offset time in accordance with the location of said time detecting apparatus, adder means for converting said GMT hour time data from said means for updating into local time data in accordance with said local offset time.

18. Time detecting apparatus as in claim 17, wherein said control means further includes shift register and comparator clock means for respectively generating a signal representative of daylight saving or standard time and an inhibit output pulse and said adder means being responsive to said standard time signal for correcting said local hour time data in accordance with daylight or standard time.

19. Time detecting apparatus as in claim 18, wherein said adder means functions to generate local 24 hour time data.

20. Time detecting apparatus as in claim 17, further compising means for converting said local 24 hour time data into local 12 hour time data for indexing digital time circuitry.

21. Time detecting apparatus as in claim 17, further comprising means for generating an alarm indicating the absence of the updating of local hour time data, said means being de-actuated in response to said third REP pulse.

22. Time detecting apparatus as in claim 18, comprising daylight/standard time control means responsive to said daylight saving or standard time signal from said detecting means and to said third REP for generating a daylight or standard time control signal for controlling the generation of said local hour time data.

23. Time detecting apparatus as in claim 22, wherein said daylight/standard time means includes daylight/-standard change logic means responsive to said local hour time data for generating a predetermined time control signal to actuate said daylight/standard time control means.

24. Time detecting apparatus as in claim 23, wherein said daylight/standard time control means further includes manually operable means for selectively generating a daylight or standard time control signal for actuating said daylight/standard time control means for generating said daylight saving time or said standard time control signal.

* * * * *